US012280290B2

(12) United States Patent
Wilson et al.

(10) Patent No.: US 12,280,290 B2
(45) Date of Patent: Apr. 22, 2025

(54) EXERCISE SYSTEM WITH A VARIABLE RESISTANCE UNIT

(71) Applicants: Harold Wilson, Holland, MI (US); Nezar Akeel, Rochester, MI (US); Armando Cali, Macomb, MI (US)

(72) Inventors: Harold Wilson, Holland, MI (US); Nezar Akeel, Rochester, MI (US); Armando Cali, Macomb, MI (US)

(73) Assignee: MAXPRO Fitness LLC, Rochester, MI (US)

( * ) Notice: Subject to any disclaimer, the term of this patent is extended or adjusted under 35 U.S.C. 154(b) by 77 days.

(21) Appl. No.: 17/817,895

(22) Filed: Aug. 5, 2022

(65) Prior Publication Data

US 2023/0173331 A1 Jun. 8, 2023

Related U.S. Application Data

(60) Provisional application No. 63/248,068, filed on Sep. 24, 2021, provisional application No. 63/157,193, filed on Aug. 6, 2021.

(51) Int. Cl.
*A63B 21/00* (2006.01)

(52) U.S. Cl.
CPC .... *A63B 21/4029* (2015.10); *A63B 21/00058* (2013.01); *A63B 21/153* (2013.01); (Continued)

(58) Field of Classification Search
CPC ..... A63B 21/4029; A63B 21/00058; A63B 21/153; A63B 21/4034; A63B 2220/833; A63B 2225/09; A63B 21/0058; A63B 2210/50; A63B 21/157; A63B 21/16; A63B 2225/20; A63B 21/4031; A63B 69/0062; A63B 21/4035; A63B 24/0087; (Continued)

(56) References Cited

U.S. PATENT DOCUMENTS 4,830,363 A * 5/1989 Kennedy ..... A63B 21/4033 434/254
10,220,261 B1 * 3/2019 Garsdean ..... A63B 24/0087
(Continued)

*Primary Examiner* — Sundhara M Ganesan
(74) *Attorney, Agent, or Firm* — Mark L. Maki; Miller Canfield

(57) ABSTRACT

An exercise system includes a bench system usable in combination with a resistance unit for the performance of a wide variety of exercises including those previously performed using free weights, exercise machines, rowing machines, and/or ski machines. The bench system preferably includes a bench unit, which is configurable in various bench configurations including flat, seated, incline and decline configurations as well as a sliding seat configuration. The bench system can include an extension unit mounted to the bench unit, wherein a resistance unit is mountable to the exercise system in a plurality of mounting positions that align with various bench configurations to permit the performance of a wide variety of resistance exercises while varying the angle of resistance generated by the pull cord on the body party being exercised. The mounting positions optimize the location of the resistance unit and the pull cords depending upon the bench configuration to vary and optimize the angle of resistance applied to the user's muscles and body parts during exercises.

23 Claims, 18 Drawing Sheets

(52) U.S. Cl.
CPC .... *A63B 21/4034* (2015.10); *A63B 2220/833* (2013.01); *A63B 2225/09* (2013.01)

(58) Field of Classification Search
CPC ..... A63B 2220/17; A63B 21/4043; A63B 2225/093; A63B 2225/50
See application file for complete search history.

(56) References Cited

U.S. PATENT DOCUMENTS

| | | | | |
|---|---|---|---|---|
| 2004/0204294 | A2* | 10/2004 | Wilkinson | A63B 22/203 482/52 |
| 2006/0189462 | A1* | 8/2006 | Pearson | A63B 21/026 482/121 |
| 2014/0113779 | A1* | 4/2014 | Loach | A63B 21/00069 310/105 |
| 2014/0200120 | A1* | 7/2014 | Gallagher | A63B 21/015 482/115 |
| 2015/0011368 | A1* | 1/2015 | Manor | A63B 23/1209 482/116 |
| 2015/0141223 | A1* | 5/2015 | Wood | A63B 23/03541 482/146 |
| 2017/0014661 | A1* | 1/2017 | Lin | A63B 23/1281 |
| 2018/0021617 | A1* | 1/2018 | Krull | A63B 21/023 482/128 |
| 2019/0118022 | A1* | 4/2019 | Carter | A63B 21/16 |

* cited by examiner

EXERCISE SYSTEM WITH A VARIABLE RESISTANCE UNIT

CROSS REFERENCE TO RELATED APPLICATIONS

This application claims priority of U.S. Provisional Patent Application No. 63/157,193 filed Aug. 6, 2021, and U.S. Provisional Patent Application No. 63/248,068 filed Sep. 24, 2021, the disclosures of which are incorporated herein by reference in their entirety.

FIELD OF THE INVENTION

The invention relates to an exercise system comprising a system of a modifiable bench system usable with a removable resistance unit, and in particular to an exercise system configured for the performance of a wide range of resistance and aerobic exercises.

BACKGROUND OF THE INVENTION

Traditional physical fitness exercise devices are well known in the art, including individual free weights and exercise machines, which incorporate weights, resistance units or mechanical resistance to facilitate strength and endurance training. For example, an exercise machine may include movable weights to generate resistance or may incorporate other resistance units such as elastic bands for exercising targeted muscle groups.

Many of these exercise machines are not particularly portable since they may be relatively large, bulky and/or heavy and typically are not moved except for short movements to reposition a machine within a training area. Many exercise machines are dedicated to one particular exercise, such as a treadmill for running and walking, a rowing machine, an exercise bike, or a ski machine. For free weights, the individual weights themselves are heavy and require a relatively large collection of different size weights in a gym area, which again limits portability or suitability for use in other areas outside of the training area. Further, many manufacturers in the fitness industry would not make all of the disparate equipment and machines used in a gym such that a training area is often outfitted with disparate equipment and accessories that require significant floor space and investment.

To address these shortcomings, the applicant for the present invention has developed a compact high resistance fitness device for improved exercising or individual rehabilitation. The resistance unit is configured with at least one resistance module and may used by itself for a range of exercises, or provided in combination with separate conventional accessories such as a simple bench or even a wall-mount to perform other exercises. One example of such a resistance unit is disclosed in PCT Application Publication No. WO 2020/014667 A1, the disclosure of which is incorporated herein by reference in its entirety. The known resistance module includes a pull cord, and a coil storage spool configured to wrap and unwrap the pull cord from the resistance module. The high strength pull cord terminates at its outer end with a handle, such as a hand/foot receptacle. The pull cord has a length sufficient to allow pull strokes of up to fifty feet or more, and the resistance module generates variable weight resistance in a compact and portable resistance unit.

It is an object of the invention to develop an improved exercise system which incorporates a resistance unit of this type in combination with an inventive bench system configured for use in performing a wide variety of exercise types.

More particularly, the invention relates to a compact high resistance fitness device for superior independent exercising or individual rehabilitation, where at least one resistance unit is provided in combination with an inventive bench construction or system. The resistance unit includes at least one and preferable two resistance modules that each include a coil storage spool configured to wrap and unwrap a pull cord emanating from the resistance module. The high strength pull cord terminates at its outer end with a connector that may connect to a handle, such as a hand/foot receptacle, or other exercise implements, wherein the pull cord has a length sufficient to allow pull strokes with a length suitable for use with the inventive exercise system. Further, the resistance module generates as much weight resistance as a user could want in a compact and portable unit, and the resistance unit can be used separate from the bench system that it is capable of being taken anywhere for use. Of special interest is that the fitness device may include sensors and other means for collecting data and relaying that data to a smartphone, a computer, the cloud or any other device for display and processing.

In a preferred configuration, the resistance unit comprises an elongated platform or base plate having a pair of concentrically acting, independent resistance modules at opposite ends of the platform. These resistance modules are capable of providing a wide range of resistance, from low to very high. Often free weights are provided as plates or dumbbells in the range of about 1-2 pounds to more than 100 pounds, and when multiple free weights are combined, an athlete might perform exercises with total weights exceeding several hundred pounds. Each resistance module generates variable resistance that can reproduce resistance that spans this range of weights. Each of the resistance modules have a respective cable that may be extended and retracted by a respective body part, such as the left and right arms or legs of a user. While the two resistance modules are actuated independently and separately by the individual body parts being exercised, the pull cords could be interconnected and be moved by a single body part driving both pull cords simultaneously.

The inventive bench system is usable in combination with the resistance module for the performance of a wide variety of exercises that typically would be performed using multiple exercise machines. Often such exercise machines would be supplied by different manufacturers, such as different manufacturers that supply free weights including plates and dumbbells, the benches, racks and accessories used with such free weights, other resistance units including resistance bands and accessories therefor, multi-station exercise machines incorporating weights or other forms of resistance, as well as separate rowing machines, ski machines, and the like. An advanced athlete typically would outfit a gym or training area with different combinations of these fitness devices, which requires significant floor space.

The inventive exercise system represents an improvement over conventional fitness equipment and preferably comprises an inventive bench unit, which is similar to a fixed flat bench in one configuration, but is configurable in various bench configurations including flat, seated, incline and decline configurations as well as a sliding seat configuration. In addition to the bench unit, the exercise system includes an extension unit that is adjustably and removably mountable to the front of the bench unit so that additional exercises may be performed with or separate from the bench unit.

The resistance unit is mountable to the bench unit or the extension unit in a plurality of mounting positions that align with the various bench configurations to permit the performance of a wide variety of resistance exercises while varying the angle of resistance generated by the pull cord on the body party being exercised. The mounting positions optimize the location of the resistance unit and the pull cords depending upon the bench configuration to vary and optimize the angle of resistance applied to the user's muscles and body parts during exercises. The inventive exercise system is usable by athletes of all skill levels but is particularly valuable for advanced athletes who might perform variations of a particular exercise to hit different muscles in an area of the body.

In more detail, the mounting positions allow for the pull cord to be extended in multiple vertically and horizontally extending orientations, so that exercises on the exercise system mimic common exercises, such as various presses, flies, rows, curls, squats, lifts, and the like. While the pull cord may be pulled upwardly for certain exercises, the resistance unit may also be mounted to permit downward pulling of the pull cord for other exercises such as pull-downs, curls and the like. Exercises may be done fast or slow. In these configurations, the resistance module may be positioned in lo, hi or intermediate positions either by locating the resistance unit directly in one of these positions, or virtually, through the use of pulleys and/or accessory cables, which here again, permits the performance of a wide variety of exercises using one or only a few resistance modules.

The inventive exercise system is particularly suitable for a wide variety of such exercises while relying upon a single resistance unit using one or two resistance modules. While only one resistance unit having two resistance modules is preferably provided for cost efficiency, it will be understood that multiple resistance units might be provided, or the resistance units might have only one resistance module rather than two or more. Of particular note, the resistance unit is readily repositionable on the bench unit in a variety of positions, and also may be dismounted for use by itself, since the resistance unit allows the performance of a variety of exercises even when used without other system components.

The extension unit includes a foot support or foot stretcher that anchors the feet of the user when sitting on the bench and includes a support frame configured to support the resistance unit thereon. In this configuration, the cable may extend horizontally toward the bench unit. When the seat is fixed and the user faces the bench, the user may perform exercises such as seated rows. The user may also reverse their position and press the pull cord if so desired. When the seat is reconfigured to a sliding seat configuration, the exercise system now operates as a rowing machine, wherein the athlete can perform a rowing technique through a full range of the rowing stroke including the drive, recovery and catch.

The extension unit may also include a display monitor that displays data associated with the inventive exercise system. In this regard, the resistance unit tracks various parameters of the pull cords to track athlete performance and displays such information through a software application displayed on the monitor. The monitor may also display third party exercise programs to either read back performance data or watch video feeds of motivational exercise programs. The monitor may also face away from the bench if the resistance unit is operated from the front side of the extension unit that is opposite to the bench.

The extension unit may also include a mast that extends upwardly and allows the resistance unit to operate in a hi configuration, either by directly positioning a resistance unit hi on the mast or virtually by providing a hi-mount cable connected by pulleys, cables or the like to a resistance unit that is located in an intermediate or lo position. When exercising on this front side of the extension unit, various weightlifting exercises can be performed. Further, the length of the pull cord and its resistance characteristics allows the pull cords to be repetitively extended and retracted in a skiing motion so that the inventive exercise device operates as a ski erg or ski machine.

The bench unit further includes additional structural features that allow for dismounting of a seatback, folding of the bench legs for storage, and adjusting the horizontal angle of the bench surface as defined by the seat and/or seatback. As disclosed herein, the exercise system is highly reconfigurable and flexible while allowing for optimized performance of a wide variety of exercises.

Therefore, in one aspect, the invention may be described as a bench system comprising:

a configurable bench unit, at least one resistance module including a coil storage spool configured to wrap and unwrap a pull cord emanating from said resistance module, said pull cord terminating at an outer end with a connector connectable to one of a handle or other exercise implements, wherein said pull cord has a length sufficient to allow pull strokes with a length suitable for performing multiple exercises by a user, said resistance unit generating resistance to extension of said pull cord;

said resistance unit being fixable to said bench in a non-movable position allowing said pull cord to be extended and retracted by a user and being separable from said bench unit for the performance of exercises separate from said bench unit; and said bench unit is configurable in various bench configurations including at least two of a flat configuration for supporting a user flat on their back, a seated configuration for supporting a user in a seated position, an incline configuration wherein said user's upper body is oriented in an incline with their head above their hips, a decline configuration wherein said user's upper body is oriented with their hips above their head, and a sliding seat configuration wherein said bench unit defines a seat section which is slidable horizontally toward and away from a back section.

In another aspect, the invention may be described as a bench system comprising:

a configurable bench unit, at least one resistance module including a coil storage spool configured to wrap and unwrap a pull cord emanating from said resistance module, said pull cord terminating at an outer end with a connector connectable to one of a handle or other exercise implements, wherein said pull cord has a length sufficient to allow pull strokes with a length suitable for performing multiple exercises by a user, said resistance unit generating resistance to extension of said pull cord;

said resistance unit being fixable to said bench in a non-movable position allowing said pull cord to be extended and retracted by a user and being separable from said bench unit for the performance of exercises separate from said bench unit; and said resistance unit being mountable to said bench unit or an extension unit at a front of said bench unit in a plurality of mounting positions to permit the performance of a wide variety of resistance exercises while varying the angle of resistance generated by the pull cord on the body party being exercised.

In a further aspect, the invention may be described as a bench system comprising:

a configurable bench unit configured to support at least one resistance module including a coil storage spool configured to wrap and unwrap a pull cord emanating from said resistance module, said pull cord terminating at an outer end with a connector connectable to one of a handle or other exercise implements, wherein said pull cord has a length sufficient to allow pull strokes with a length suitable for performing multiple exercises by a user, said resistance unit generating resistance to extension of said pull cord;

said bench unit being configured to support said resistance unit in a non-movable position allowing said pull cord to be extended and retracted by a user and being separable from said bench unit for the performance of exercises separate from said bench unit; and said bench unit being configurable in various bench configurations including at least two of a flat configuration for supporting a user flat on their back, a seated configuration for supporting a user in a seated position, an incline configuration wherein said user's upper body is oriented in an incline with their head above their hips, a decline configuration wherein said user's upper body is oriented with their hips above their head, and a sliding seat configuration wherein said bench unit defines a seat section which is slidable horizontally toward and away from a back section.

Other objects and purposes of the invention, and variations thereof, will be apparent upon reading the following specification and inspecting the accompanying drawings.

Figure 1:
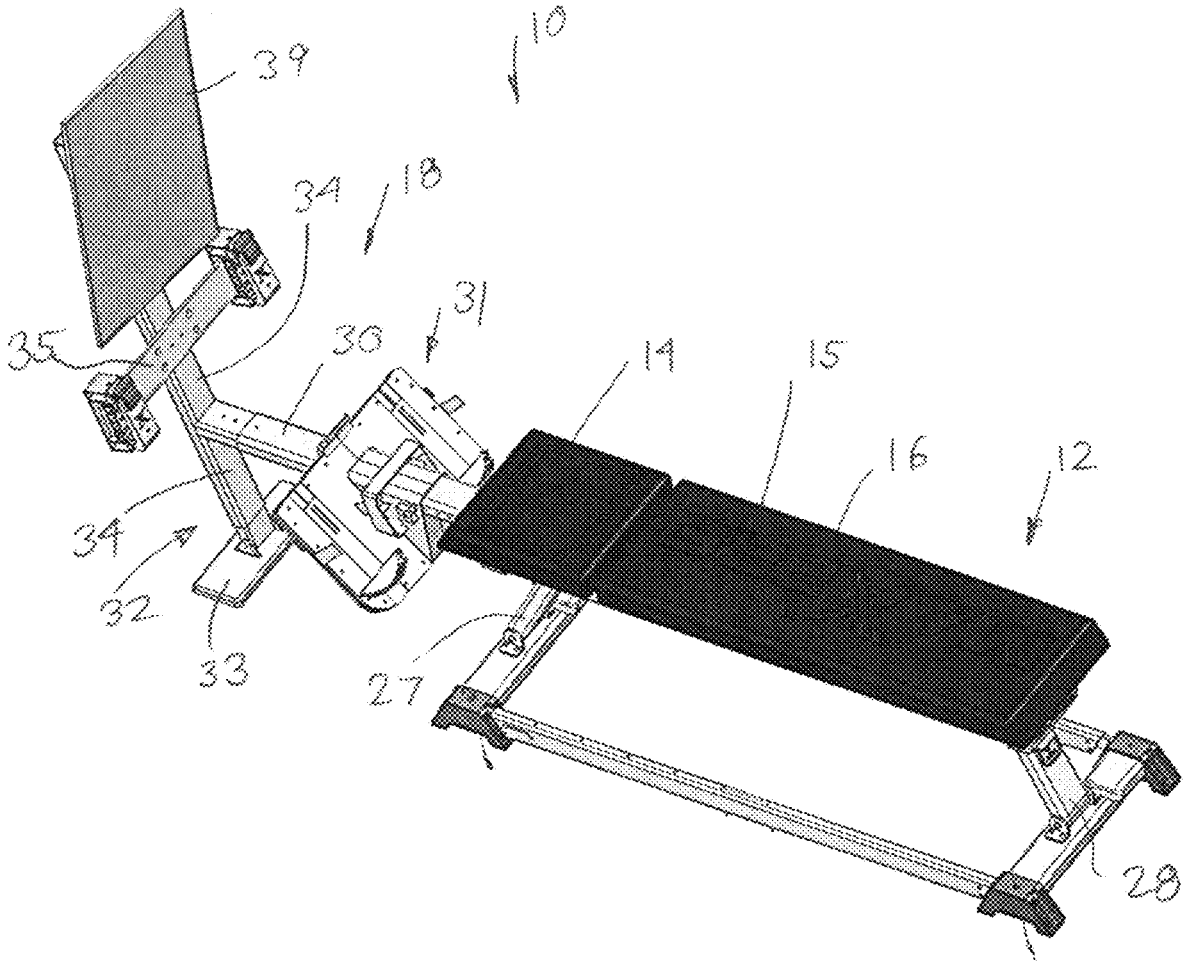
FIG. 1 is a perspective view of an exercise system according to the present invention comprising a bench unit and a front extension unit.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, an inventive exercise system 10 preferably comprises an inventive bench unit 12 having a seat 14 and seatback 15, which are similar to a fixed flat bench in one configuration (FIG. 1). However, the seat 14 and seatback 15 are configurable in various bench configurations including: flat with the seat 14 and seatback 15 lying flat (FIG. 1); seated with the seatback 15 upright to its forwardmost position; inclined with the seatback 15 in one of several inclined positions (FIG. 12) and declined with the legs folded so that the bench surface 16 declines from front to back, as well as a sliding seat configuration (FIG. 2) as disclosed in more detail herein. In addition to the bench unit 12, the exercise system 10 includes an extension unit 18 that is adjustably and removably mountable to the front of the bench unit 12.

Figure 2:
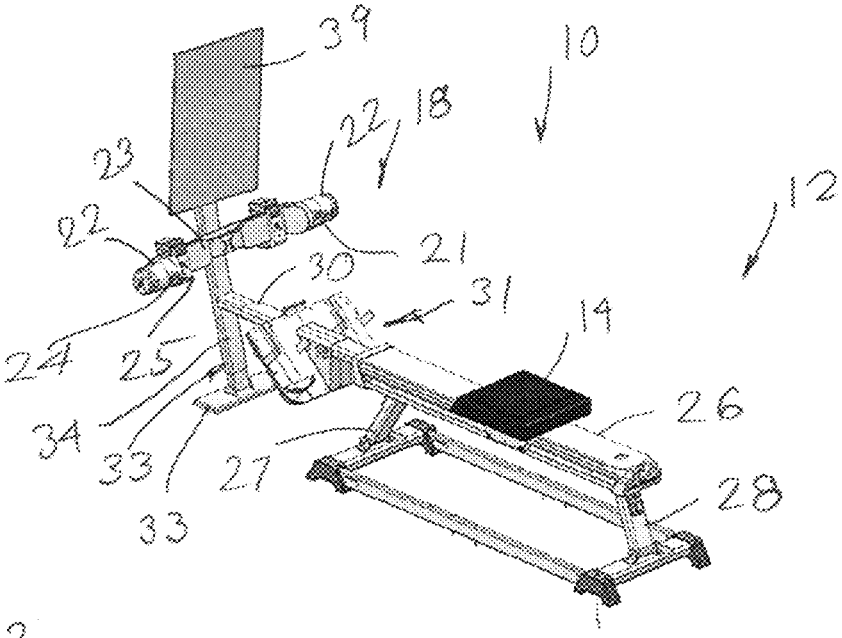
FIG. 2 is a perspective view of the exercise system with a seatback removed from the bench unit.
Figure 3:
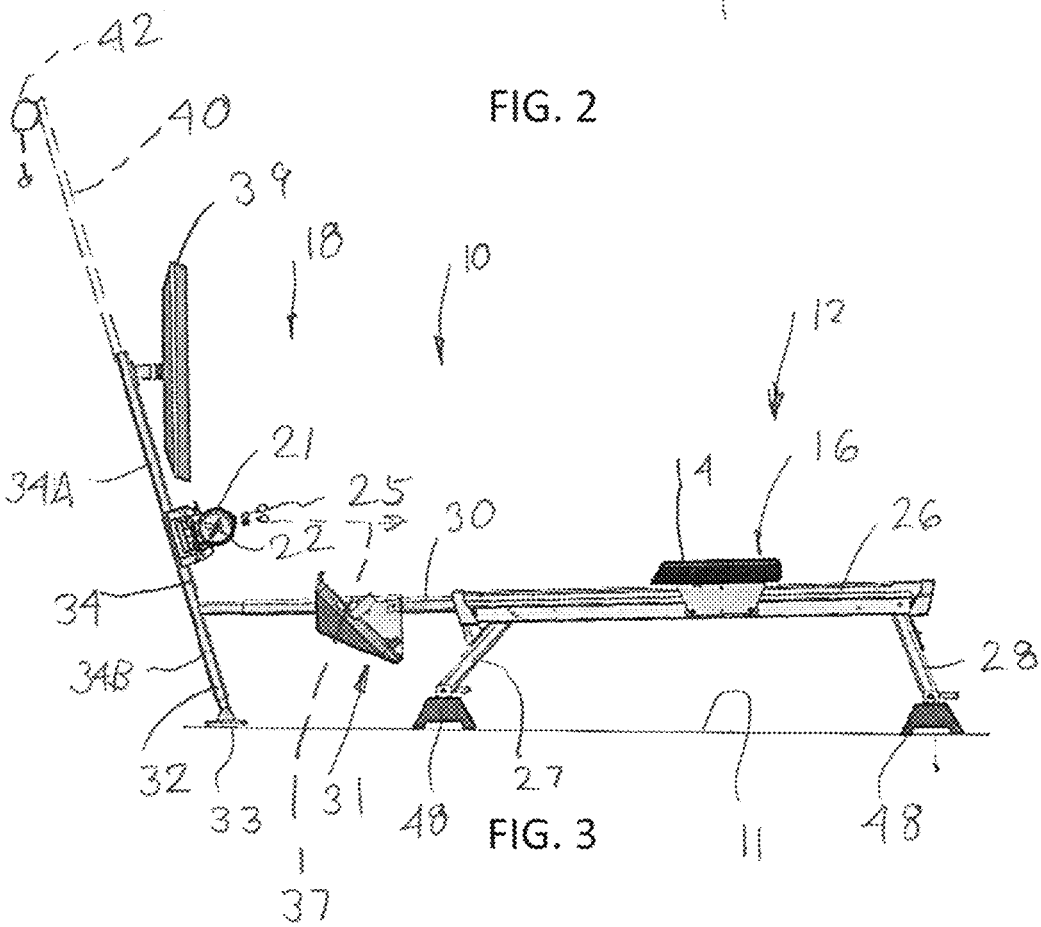
FIG. 3 is a side view of the exercise system with the seatback removed.

Referring to FIGS. 2 and 3, the bench system 12 is usable in combination with a resistance module 21 for the performance of a wide variety of exercises that typically would be performed using multiple exercise devices. As noted above, known exercise devices often are supplied by different manufacturers, such as different manufacturers that supply free weights and resistance units and accessories therefor, benches, rowing machines, ski machines, and the like. The inventive exercise system 10, however, allows numerous exercises to be performed by combining the resistance unit 21 with the bench system 12 as will be apparent from the following disclosure.

As one example, the resistance unit 21 may be of the type disclosed in PCT Application Publication No. WO 2020/014667 A1, the disclosure of which is incorporated herein by reference in its entirety. In a resistance unit 21 as disclosed herein and shown in FIGS. 2, 3 and 8, the resistance unit 21 comprises one or more resistance modules 22 supported on an elongated platform or base plate 23, which may be foldable or may have a fixed length. The base plate 23 preferably has a pair of concentrically acting, independent resistance modules 22 at opposite ends of the platform 23. These resistance modules 22 are capable of providing a wide range of resistance, from low to very high and each have a respective cable 24 that may be extended and retracted by a respective body part, such as the left and right arms or legs of a user. While the two resistance modules 22 operate independently and separately by the individual body parts, the pull cords 24 could be interconnected and moved by a single body part driving both pull cords 24 simultaneously.

For an understanding of the present invention, each of the resistance modules 22 includes a coil storage spool configured to wrap and unwrap the pull cord 24 emanating from the resistance module 22. The high strength pull cord 24 terminates at its outer end with a connector 25 that may connect to a handle, such as a hand/foot receptacle, or other exercise implements, wherein the pull cord 24 has a length sufficient to allow pull strokes with a length suitable for use with any of the exercises that may be performed using the inventive exercise system 10. Further, the resistance module 24 generates a variable amount of weight resistance so that the single resistance module 24 can provide as little or as much weight-like resistance as a user could want in a compact and portable unit. Of special interest is that the fitness device may include sensors and other means for collecting data and relaying that data to a smartphone, a computer, the cloud or any other device for display and processing.

As disclosed herein, the inventive exercise system 10 is particularly suitable for a wide variety of such exercises while relying upon a single resistance unit 21 using one or two resistance modules 22. While only one resistance unit 21 is preferably provided for cost efficiency, it will be understood that multiple resistance units 21 might be provided, or the resistance units 21 might have only one resistance module 22 rather than two or more. Of particular note, the resistance unit 21 is readily repositionable on the bench unit 12 in a variety of positions as disclosed in more detail herein. The resistance unit 21 also may be dismounted for use by itself, since the resistance unit 21 allows the performance of a variety of exercises even when used without other system components such as the bench unit 12 or extension unit 18.

Generally, as to the bench unit 12 as shown in FIGS. 1-3, the bench unit 12 comprises a main beam 26, which slidably supports the seat 14 thereon, and also supports the seatback 15 thereon. As will be described further below, the seatback 15 may lie flat, be inclined or even be removed depending upon the exercise being performed. The main beam 26 is supported on front and back legs 27 and 28, which are extendible for use as shown, and foldable to a variable angle to adjust the bench angle or foldable to a stored position for storage. The main beam 26 and front and back legs 27 and 28 thereby define a framework forming a base for the bench unit 12, which is configured to support the bench unit 12 on the floor surface 11 of a workout area on which the bench unit 12 is placed or positioned.

Next, the extension unit 18 includes a support rail 30 that can be removably fixed to the front end of the bench unit 12. The support rail 30 includes a foot support or foot stretcher 31 that anchors the feet of the user when sitting on the bench unit 12 and includes a front support frame 32 on the front distal end thereof. The front support frame 32 has a foot pad 33 and an upright 34 configured to support the resistance unit 21 thereon (FIGS. 2 and 3) by a mount 35. The mount 35 is configured to support the resistance unit 21 in an intermediate position at an elevation just above the foot stretcher 31, wherein the pull cord 24 may extend horizontally toward the bench unit 12 as indicated by reference arrow 37 (shown in phantom outline). If desired, the resistance unit 21 may be flipped with the pull cords 24 extending in the direction opposite reference arrow 37 toward the front of the extension unit 18.

When the seat 14 is fixed as in FIG. 1 and the user faces away from the bench unit 12 toward the upright 34, the user may perform exercises such as seated rows. The user may also reverse their position on the seat 14 and face away from the upright 34 for performing exercises that press the pull cord 24 in direction 37 if so desired. When the seatback 15 is removed, the seat is reconfigured to a sliding seat configuration as seen in FIGS. 2 and 3 wherein the seat 14 can slide away and toward the front end of the bench unit 12. As such, the exercise system now operates as a rowing machine when the pull cord 24 is extended and retracted in direction 37, wherein the athlete can perform a rowing technique through a full range of a conventional rowing stroke including the drive, recovery and catch.

The extension unit 18 may also include a display monitor 39 on the upper end of the upright 34, wherein the monitor can display data associated with the inventive exercise system 10. In this regard, the resistance unit 21 tracks various parameters of the pull cords 24 to track athlete performance and displays such information through a software application displayed on the monitor 39. The monitor 39 may also display third party exercise programs to either read back performance data or watch video feeds of motivational exercise programs. The monitor 39 may also be repositioned to face away from the bench unit 12 if the resistance unit 21 is operated from the front side of the extension unit 18, which is opposite to the bench unit 12.

The extension unit 21 may also include a mast 40 that extends upwardly from the upright 34 and allows the resistance unit 21 to operate in a hi configuration. The resistance unit 21 might be located directly in a hi position on the mast 40 as indicated by reference numeral 42. For descriptive purposes, the reference numeral 42 may identify a resistance unit 21 mounted hi on the mast, wherein its respective pull cord 24 would extend downwardly for use in strength training exercises or as a ski erg or ski machine or for resistance exercises such as pulldowns or reverse curls. The reference numeral 42 might alternatively indicate a pulley, wherein the resistance unit 21 is positioned in the intermediate position shown in FIG. 2 but operates vertically as if it was in a hi-position through the provision of one or more pulleys and cables extending vertically from the pull cords 24 up to a hi pulley and then down to the athlete for use in strength or ski training. When exercising on this front side of the extension unit 18, various weightlifting exercises can be performed. Further, the length of the pull cord 24 and its resistance characteristics allows the pull cords 24 to be repetitively extended and retracted in a skiing motion so that the inventive exercise device 10 can operate as a ski erg or ski machine whether the resistance unit 21 is in the intermediate position shown or the hi position indicated by reference numeral 42.

The bench unit 12 further includes additional structural features that allow for dismounting of a seatback 15, folding of the bench legs 27 and 28 such as for storage or for adjusting the horizontal angle of the bench surface 16 as defined by the seat 14 and/or seatback 15. As further disclosed herein, the exercise system 10 is highly reconfigurable and flexible while allowing for optimized performance of a wide variety of exercises.

Figure 4:
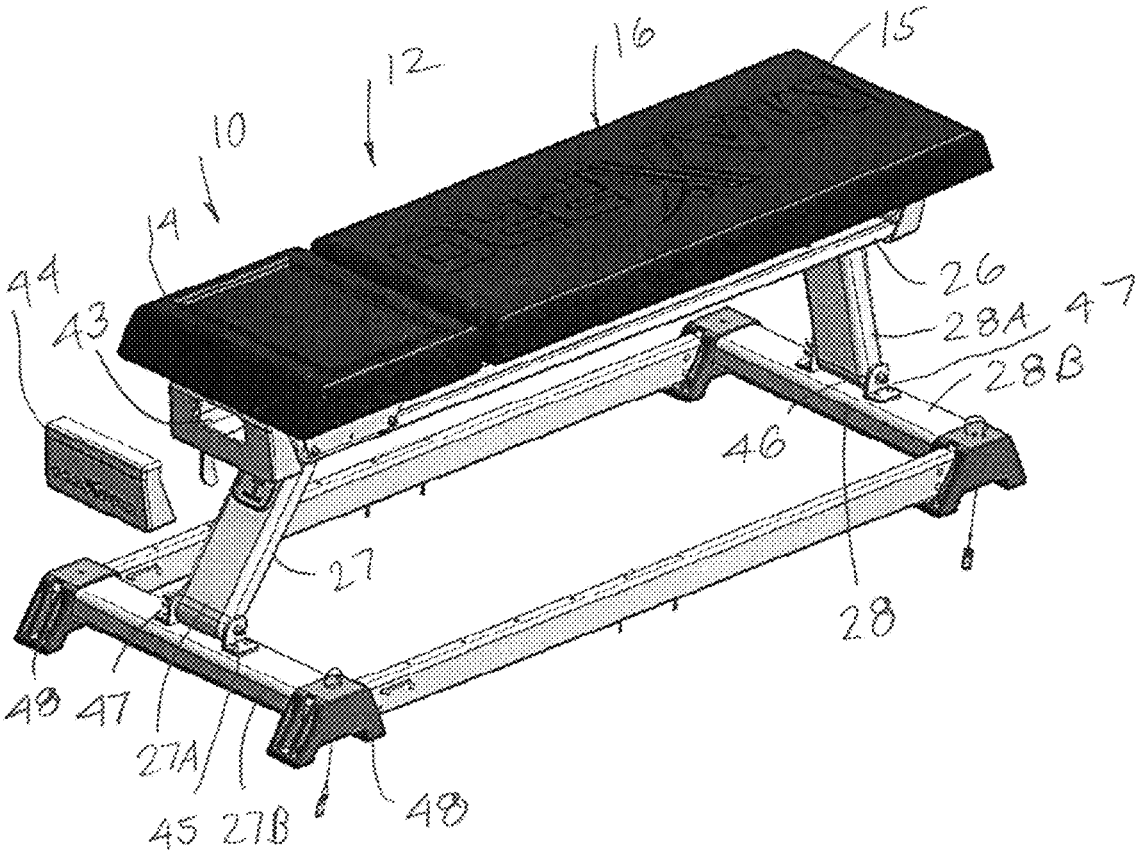
FIG. 4 is a perspective view of the bench unit.

In more detail as to the bench unit 12, FIG. 4 is a perspective view of the front and back legs 27 and 28 projecting downwardly to orient the bench unit 12 and bench surface 16 along with the main beam 26 in a horizontal orientation. As seen in FIG. 3, the bench unit 12 may also have an incline or decline relative to a floor surface 11 depending upon the angular orientation of the front and back legs 27 and 28. The front end of the main beam 26 includes a hollow rail socket 43 for receiving the horizontal support rail 39 of the extension unit 18 The rail socket 43 may be closed by a removable cover 44 when the bench unit 12 does not include the extension unit 18, or opened when inserting the support rail 39 therein.

Figure 5:
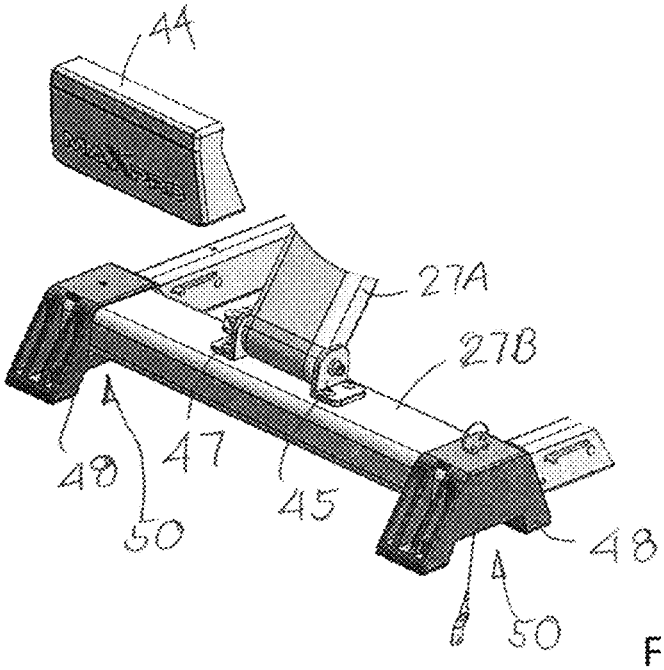
FIG. 5 is a partial view of a front leg of the bench unit.
Figure 6:
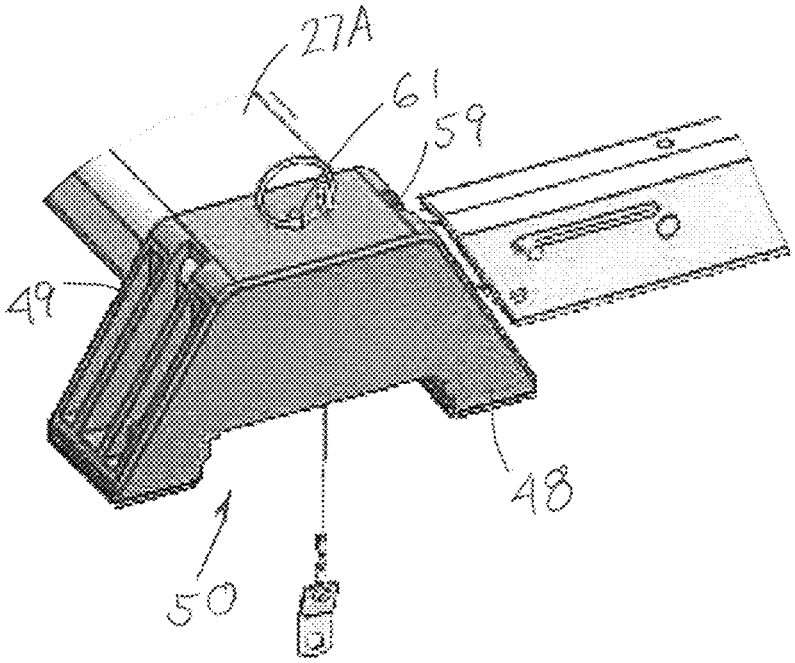
FIG. 6 is an enlarged fragmentary view of FIG. 5.

The front and back legs 27 and 28 may project downwardly as seen in FIG. 4 and include leg posts 27A and 28A and cross bars 27B and 28B, which are respectively joined together by pivot joints 45 and 46. This allows the cross bars 27B and 28B to conform to the floor surface 11 depending upon the angles of the front and back legs 27 and 28. Further, lock units 47 are provided to fix the angle of the cross bars 27B and 28B. The opposite ends of the cross bars 27B and 28B each include a foot block 48 as seen in FIGS. 5 and 6 that is configured to contact the floor surface 11. Each foot block 48 has a main body 49 that fits sidewardly onto a respective end of a cross bar 27B or 28B and in turn defines a downward opening channel 50 that is configured to fit over the platform 23 of the resistance unit 21.

Figure 7:
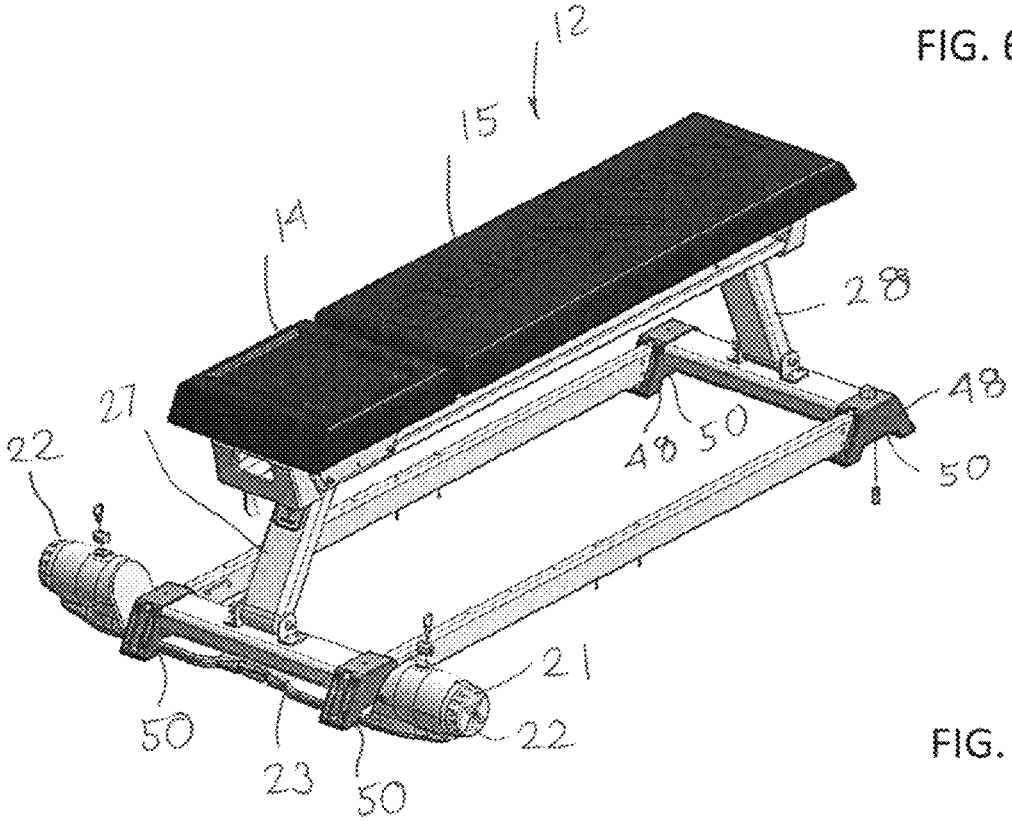
FIG. 7 is a perspective view of the bench unit in combination with a resistance unit in a forward, low position.
Figure 8:
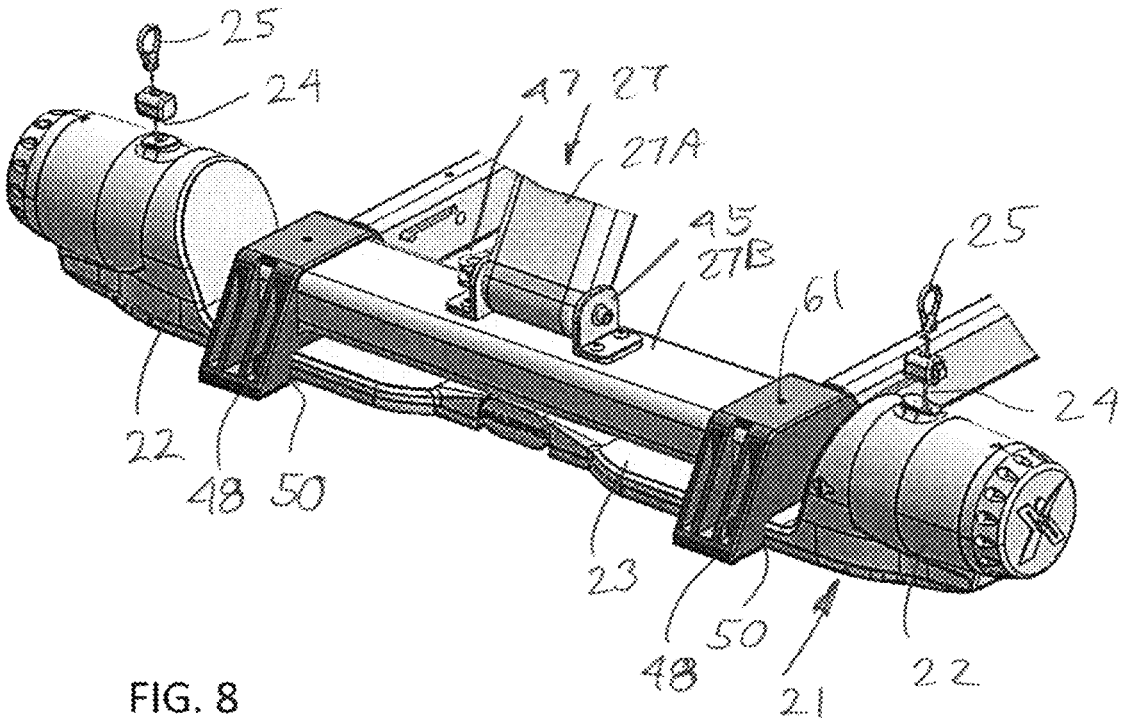
FIG. 8 is an enlarged fragmentary view of FIG. 7.

Referring to FIGS. 7 and 8, the resistance unit 21 may be placed on the floor surface 11 and then the foot blocks 48 dropped over the platform 23. The channels 50 confine the resistance unit 21 and prevent movement upwardly, forwardly and rearwardly, as well as sidewardly since the resistance modules 22 lie on the outside of the foot blocks 48. The downward force generated by the user on top of the bench unit 12 including the counterforce generated during exercise restrains the resistance unit 21 vertically such that it is not necessary to fasten the bench unit 12 to the floor surface 11. In other words, the user during exercise pushes upwardly which generates a lifting force on the resistance unit 12, but at the same time, the user generates a downward counterforce that is opposite to and counters the lifting force so that the resistance unit 21 is restrained upwardly from above by the foot blocks 48 and the downward counterforce acting therethrough and is restrained downwardly from below by the floor surface 11.

FIGS. 7 and 8 show a forwardmost lo position for the resistance unit 21 when engaged with the front foot blocks 48 of the bench unit 12. The channels 50 on the back foot blocks 48 of the back legs 28 also define another lo position, i.e., the rearmost lo position on the bench unit 12.

Therefore, the extension unit 18 defines one or more mounting locations for the resistance unit 21, which may be intermediate or hi positions, while the bench unit 12 defines additional lo positions for locating the resistance unit 21. In this regard, the front and back legs 27 and 28 are configured to restrain resistance unit 21 in the forwardmost and rearmost lo positions defined by the pairs of foot channels 50 on the front and back legs 27 and 28.

Figure 9:
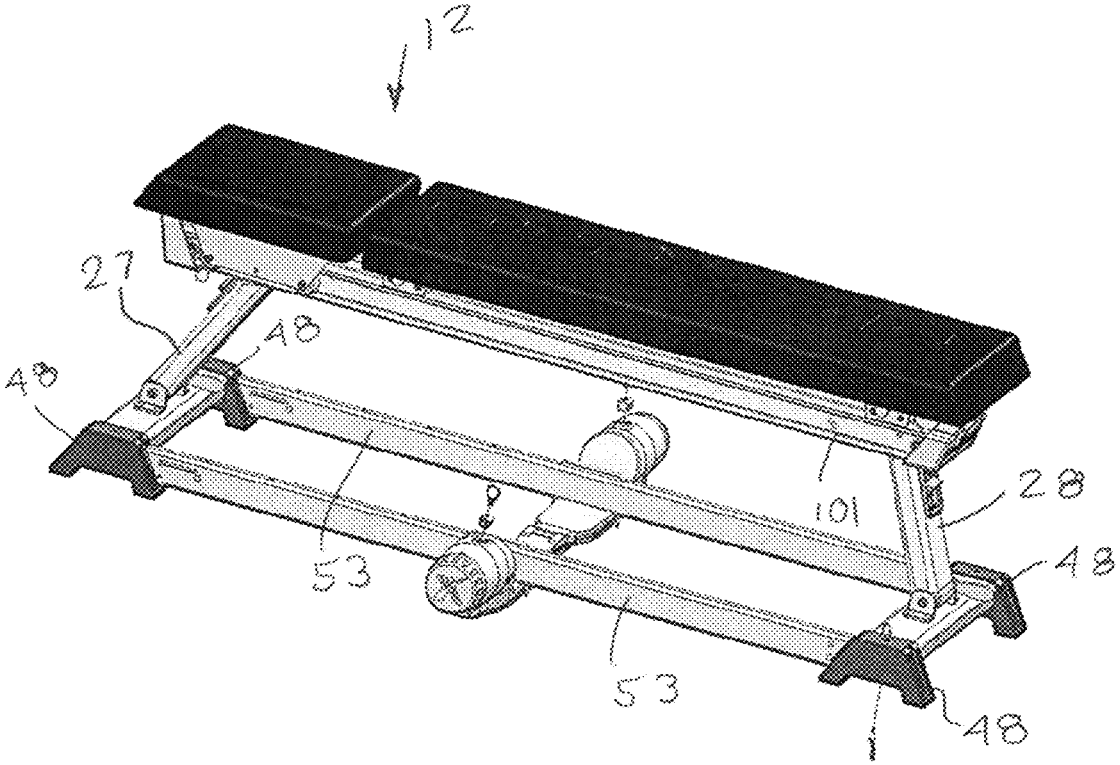
FIG. 9 is a perspective view of the bench unit with the resistance unit in an alternate lo position.
Figure 10:
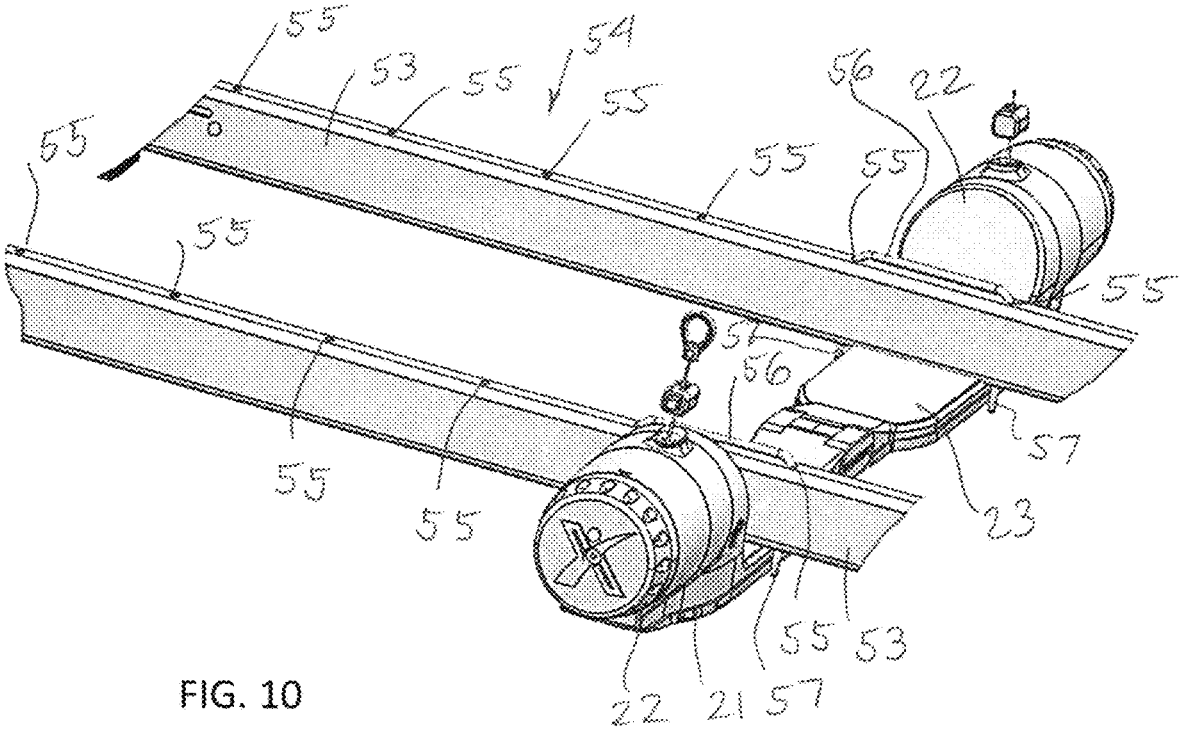
FIG. 10 is an enlarged fragmentary view of FIG. 9.

Further, the bench unit 12 defines additional lo positions between the forwardmost and rearmost lo positions described above. In this regard, FIGS. 9 and 10 illustrate the bench unit 12 with the resistance unit 21 in one of several alternate lo positions. In more detail, the bench unit 12 preferably includes a pair of locator rails 53, which have their opposite ends removable engaged with the foot blocks 48. The locator rails 53 are raised above the floor level or floor surface 11 so that the platform 23 of the resistance unit 21 can pass underneath as seen in FIGS. 9 and 10. Here again, the downward force generated by the user on the bench unit 12 prevents the bench unit 12 from lifting and thereby restrains the resistance unit 21 vertically. Effectively, each resistance unit 12 is captured vertically between the floor surface 11 and the bench unit 12, and the bench unit 12 is prevented from lifting from the floor surface 11 by the counterforce generated by the user's muscles during exercise, so that additional fasteners and locks are not required to restrain vertical movement of the bench unit 12 while the resistance unit 12 is restrained vertically upwardly by the bench unit 12 from above and downwardly by the floor surface 11 from below.

Figure 11:
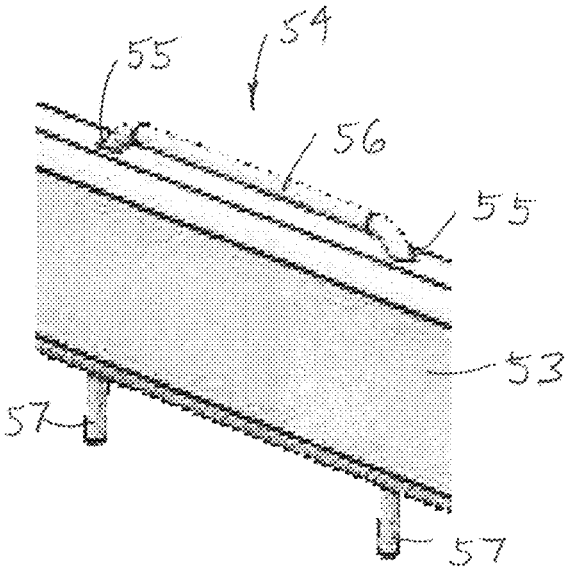
FIG. 11 is an enlarged fragmentary view of FIG. 10.

To confine the resistance unit 12 in the forward and rearward directions, locking formations 54 are provided to lock the horizontal position of the resistance unit 21. In the preferred embodiment, the locator rails 53 include spaced vertical bores 55 that cooperate with a U-shaped lock member 56. The ends of the side legs of the lock member 56 project downwardly out of the locator rail 53 as seen in FIG. 11 to thereby confined horizontal movement of the resistance unit 21. Essentially these locking formations 54 comprise the bores 55 and lock member 56 to define multiple, incrementally-spaced, lo positions in which the resistance unit 21 may be positioned along the length of the locator rails 53. It will be understood that other devices may be used. For example, the locking formations 54 might comprise horizontal slots and lock structures that engage the slots.

Figure 12:
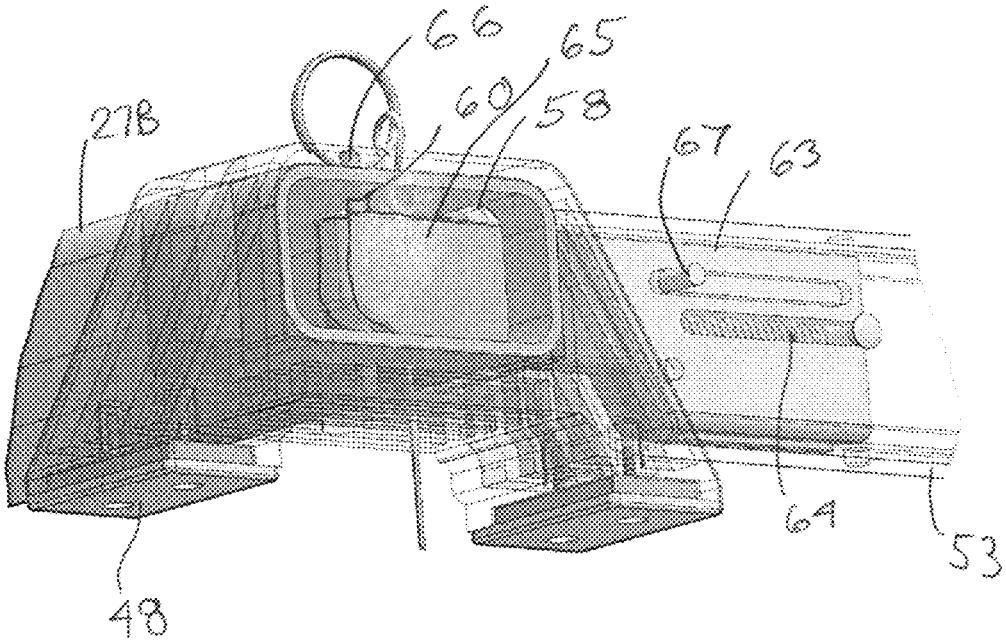
FIG. 12 is a partial view showing a lower locator rail engaged with a bench leg.
Figure 13:
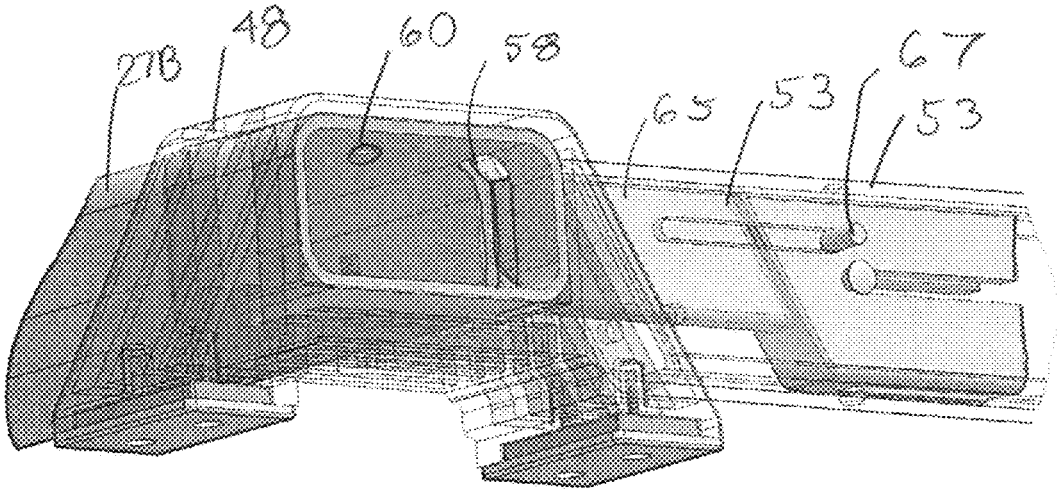
FIG. 13 illustrates the support rail of FIG. 14 being disengaged.

The locator rails 53 may be removed to permit folding of the legs 27 and 28. FIG. 12 is a partial view showing the locator rail 53 engaged with the bench leg 27 and FIG. 13 illustrates the locator rail 53 of FIG. 12 being disengaged. It will be understood that the connection of each end of a locator rail 53 to a respective leg 27 or 28 is the same as that disclosed in FIGS. 12 and 13. In more detail, each end of a leg cross bar 27 (or 28) and each foot block 48 includes respective aligned slots 58 (FIGS. 12 and 13) and 59 (FIG. 6) and aligned locking bores 60 (FIGS. 12 and 13) and 61 (FIG. 6) for engagement with the respective end of the locator rail 53.

The locator rail 53 includes a plunger 63, which reciprocates within the locator rail 53 and is biased by spring 64. A nose 65 of the plunger 63 is slidable into the slots 58 and 59 wherein the bores 60 and 61 come into alignment for receipt of a pin-shaped lock 66 as seen in FIG. 12. This allows mounting of the locator rails 53 to the bench legs 27 and 28. When the lock 66 is disengaged or removed, the plunger 63 can be pulled out of engagement with the slots 58 and 59 by a manually-movable drive handle 67. In this manner, each plunger 63 can be disengaged from the slots 58 and 59 and the locator rails 53 can be removed or installed as needed.

Figure 14:
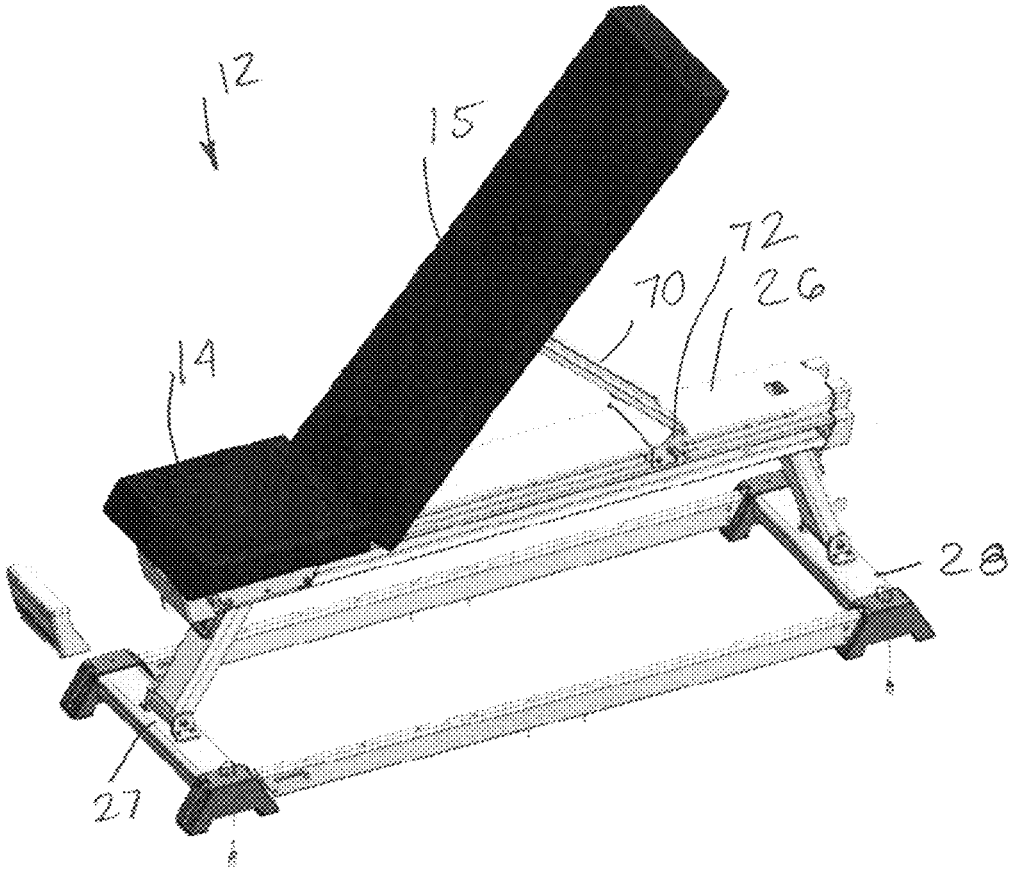
FIG. 14 is a front perspective view illustrating the bench unit in an inclined configuration.
Figure 15:
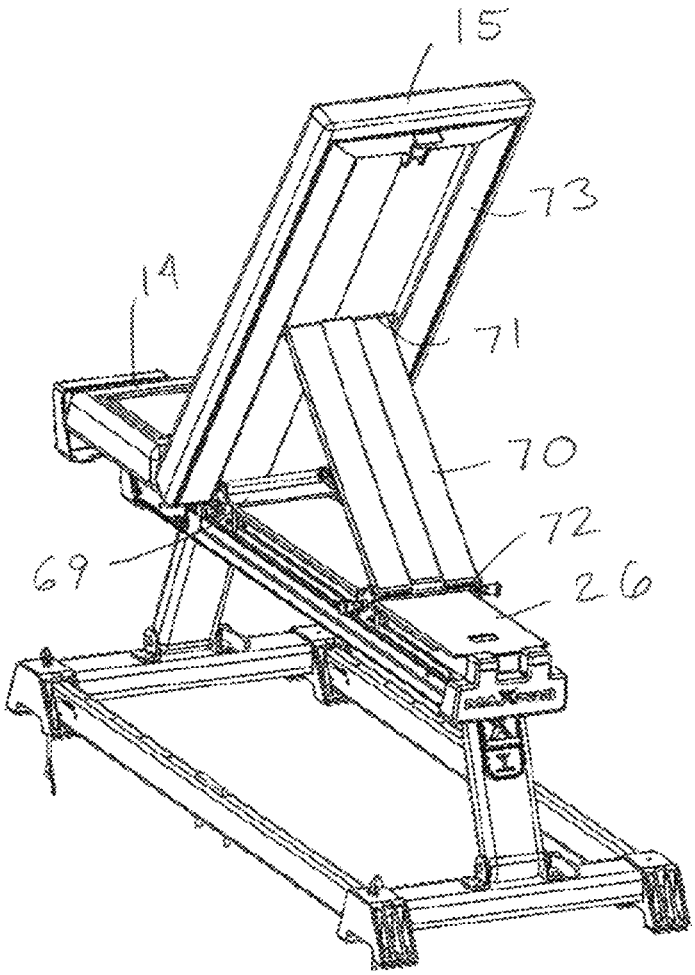
FIG. 15 is a rear perspective view of FIG. 14.

Next, the seat 14 and seatback 15 of the bench unit 12 may lie flat as seen in FIG. 1 but also are independently movable. FIGS. 14 and 15 illustrate the bench unit 12 in an inclined configuration, wherein the seat 14 is positioned in its forwardmost position, and the seatback 15 is inclined to one of a plurality of inclined positions. The seat 14 generally remains flat but is slidable. The seatback 15 is pivoted at its front end by a forward pivot joint 69 and supported by frame rail 70 having upper and lower ends which have upper and lower pivot joints 71 and 72 that are both pivotable and slidable. In this regard, the seatback 15 has an inner frame 73 (FIG. 15) along which the upper pivot joint 71 can slide. The lower pivot joint 72 is connected to the main beam 26. The seatback 15 is also removable to permit the seat 14 to slide along the main beam 26.

Figure 16:
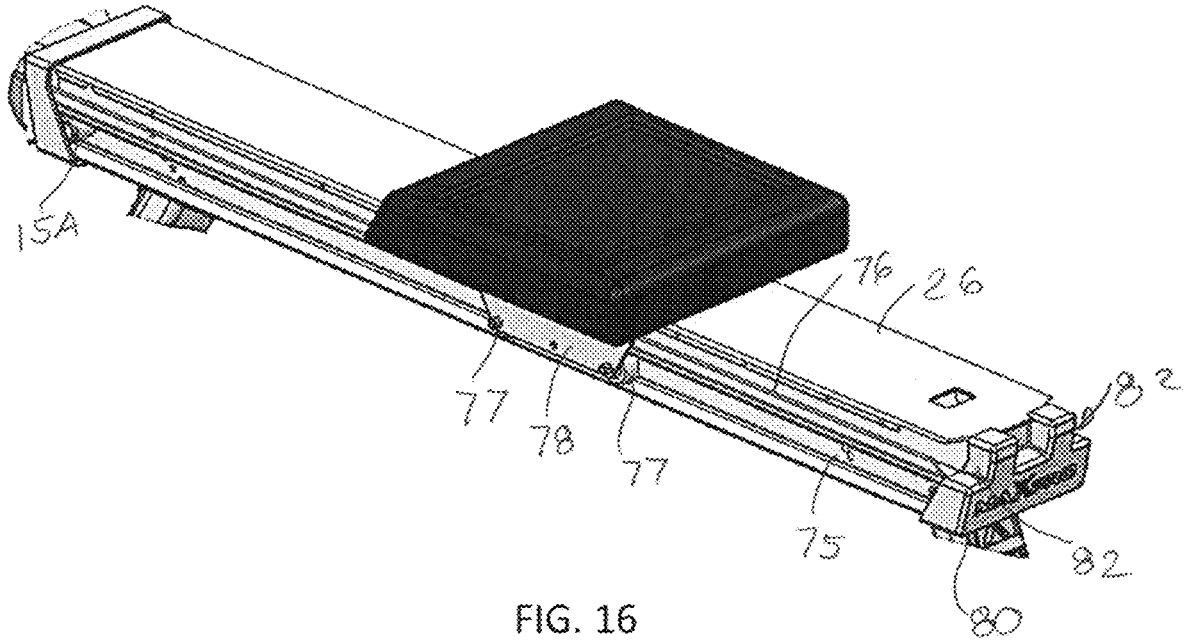
FIG. 16 is an enlarged, partial perspective view of the bench unit configured with a sliding seat.
Figure 17:
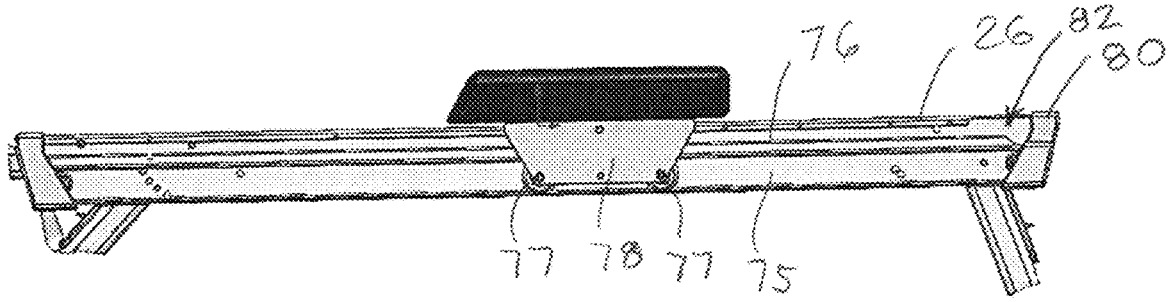
FIG. 17 is a side view of FIG. 16.

In more detail, FIG. 16 is an enlarged, partial perspective view of the bench unit 12 configured with a sliding seat 14 that is slidably connected to and slidable along the main beam 26. The main beam 26 includes two slide formations, namely a lower slide track 75 and upper slide track 76 on each opposite side of the main beam 26 as seen in FIGS. 16 and 17. The seat 14 includes a carriage 77 having wheels 78 that travel or slide along a horizontal path defined by the lower slide tracks 75. The carriage 77 supports the inner frame 79 of the seat 14 (FIGS. 18 and 19) so that the seat 14 overlies and is spaced above the main beam 26. Forward movement of the seat 14 is restrained by a stop 15A (FIG. 16) at the front end of the main beam 26, and rearward movement is restrained by the seatback 15 when installed. However, rearward movement of the seat 14 is freely permitted when the seatback 15 is uninstalled, at least until the seat 14 reaches a rear beam cover 80. The slidability of the seat 14 is useful for various exercises including rowing movements.

Figure 18:
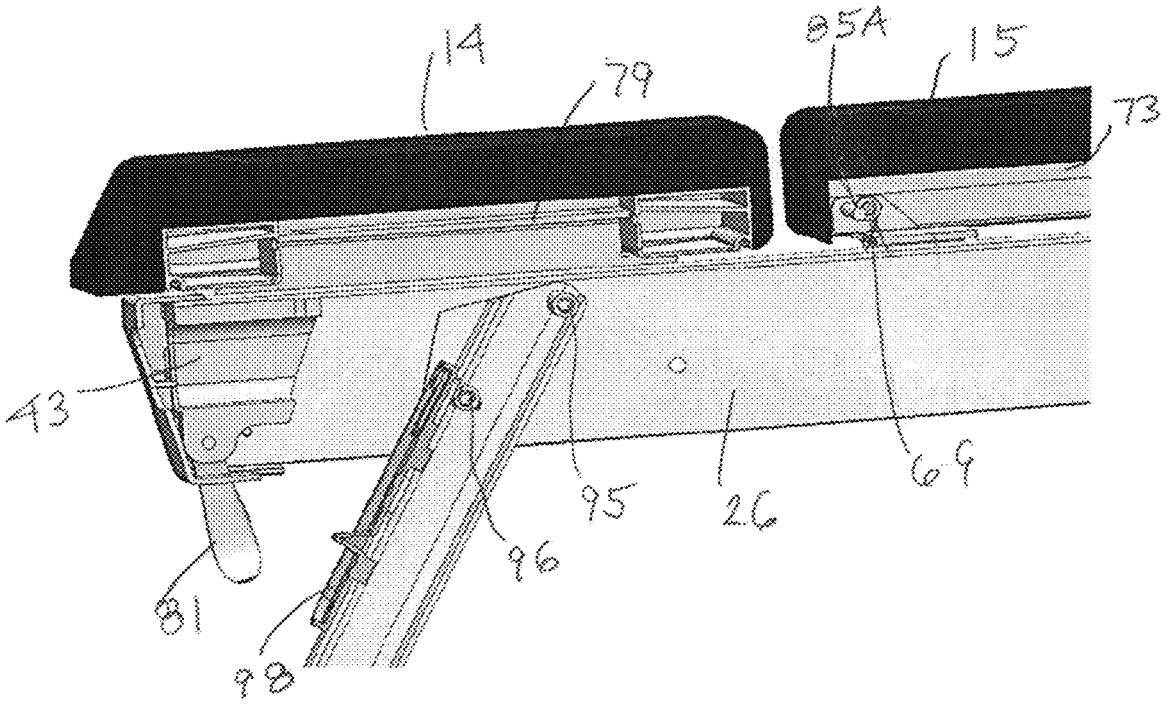
FIG. 18 is a cross sectional side view of a front end of the bench unit.
Figure 19:
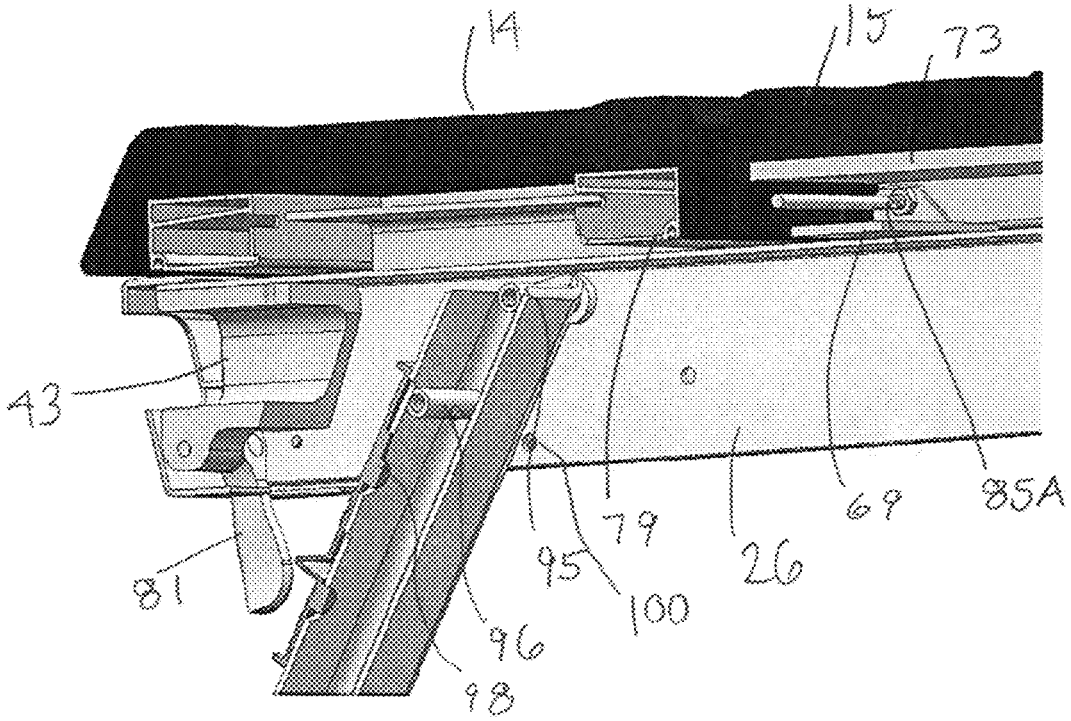
FIG. 19 is a cross sectional perspective view of the front end of the bench unit.

When the seat 14 is in the forward position as shown in FIGS. 18 and 19, the seat 14 generally overlies the main beam 26 proximate the rail socket 43 for the extension unit 18. A lock unit 81 is also provided for locking the front extension support rail 30 in place.

Further as to FIGS. 16 and 17, the upper slide track 76 is configured to slidably engage with the forward pivot joint 69 and lower pivot joint 72 to permit the seatback 15 to be raised and lowered between the flat position of FIG. 1 and a plurality of inclined positions. The upper slide track 76 on each side of the main beam 26 extends along the length thereof and is closed at the front end. However, the back end is open at track openings 82 to permit removal of the seatback 15 as described below.

Figure 20:
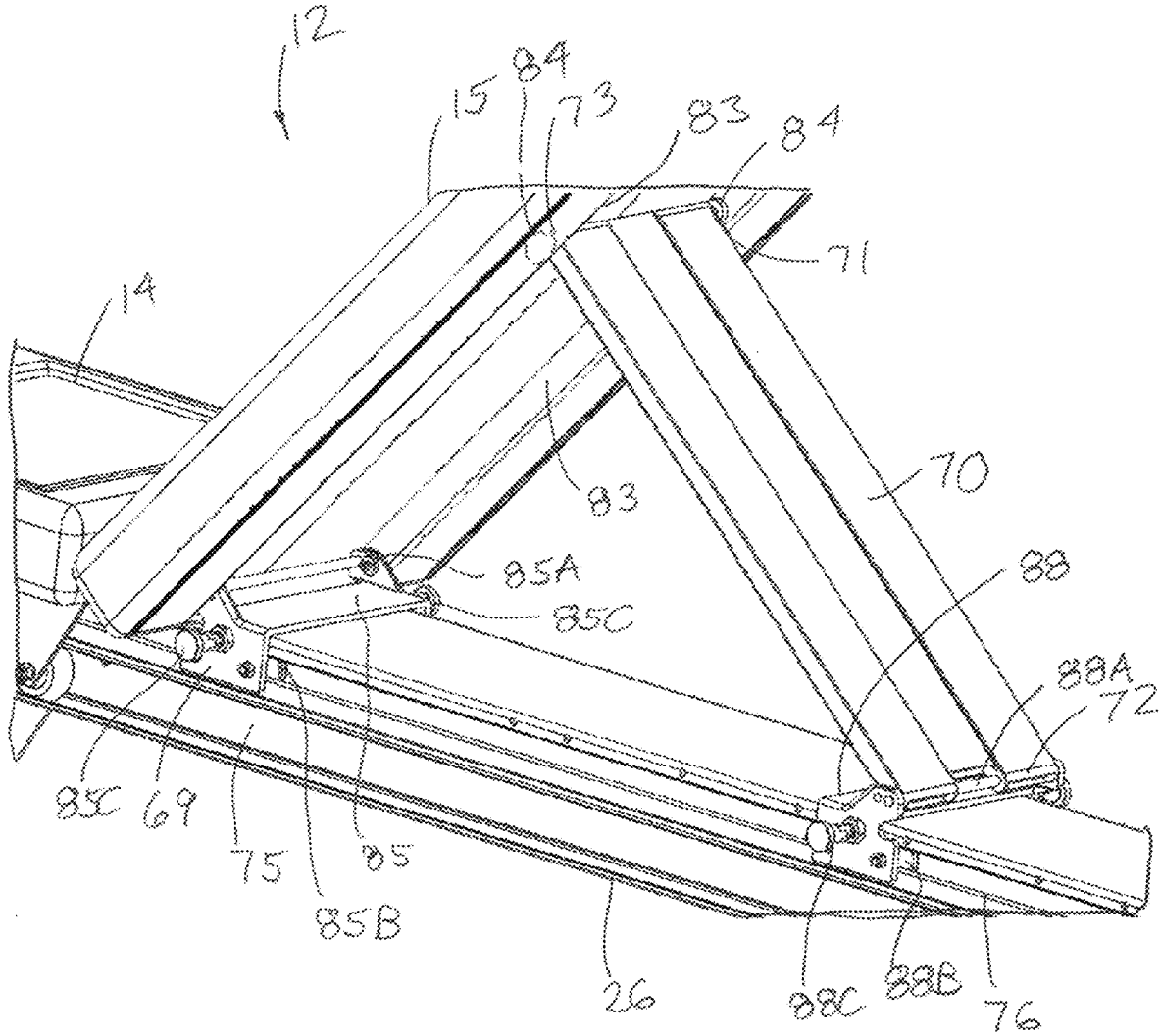
FIG. 20 is an enlarge partial view of the seatback in an inclined position.

In more detail, FIG. 20 illustrates the seatback 15 with the inner frame 73 having interior slide tracks 83. The upper pivot joint 71 includes guide wheels 84 on the upper end of the seatback frame rail 70 so that the frame rail 70 can move and pivot along the slide tracks 83 during raising and lowering of the seatback 15.

Figure 21:
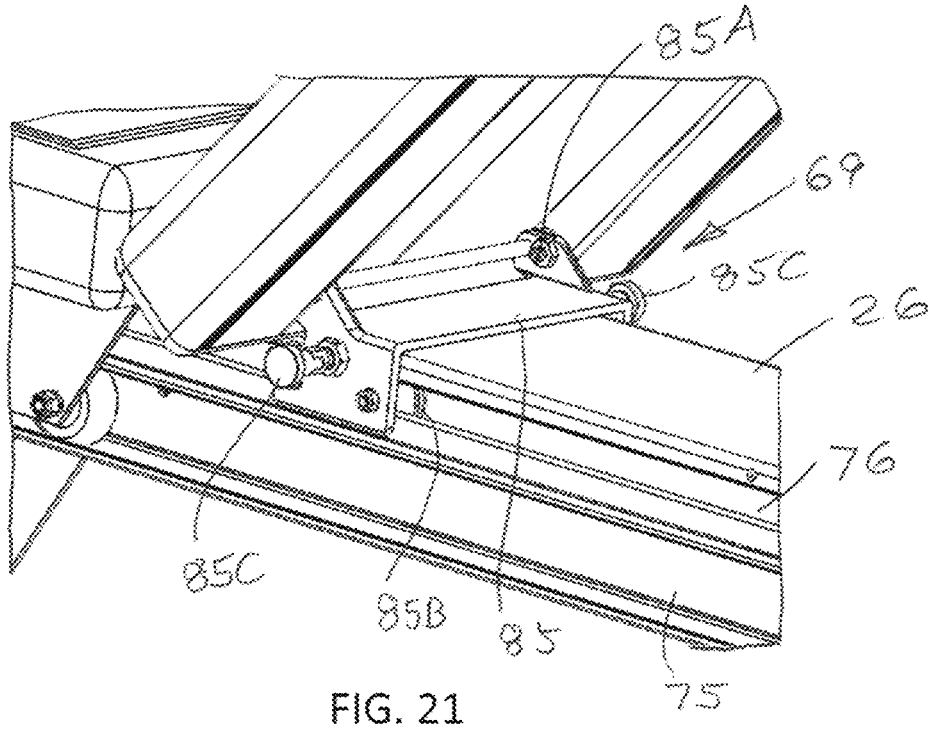
FIG. 21 is an enlarge partial view of a front hinge joint with the seatback in an inclined position.

The seatback 15 pivots about the front pivot joint 69, which is pivotable and slidable along the upper slide track 76 but also is lockable. Referring to FIGS. 20 and 21, the front pivot joint 69 has a front bracket 85 that is pivotally connected to the seatback frame 73 by pins 85A, and slidably connected to the upper slide track 76 by slides 85B. The front bracket 85 also has lock members 85C that can releasably engage with corresponding bores in the main beam 26 to lock the front end of the seatback 15 in position adjacent to the seat 14. When the lock members 85C are released or unlocked, the entire seatback 15 is slidable along the upper slide track 76 and may be removed from the main beam 26 by sliding the slides 85B along the upper slide track 76 and out of the track openings 82.

Figure 22:
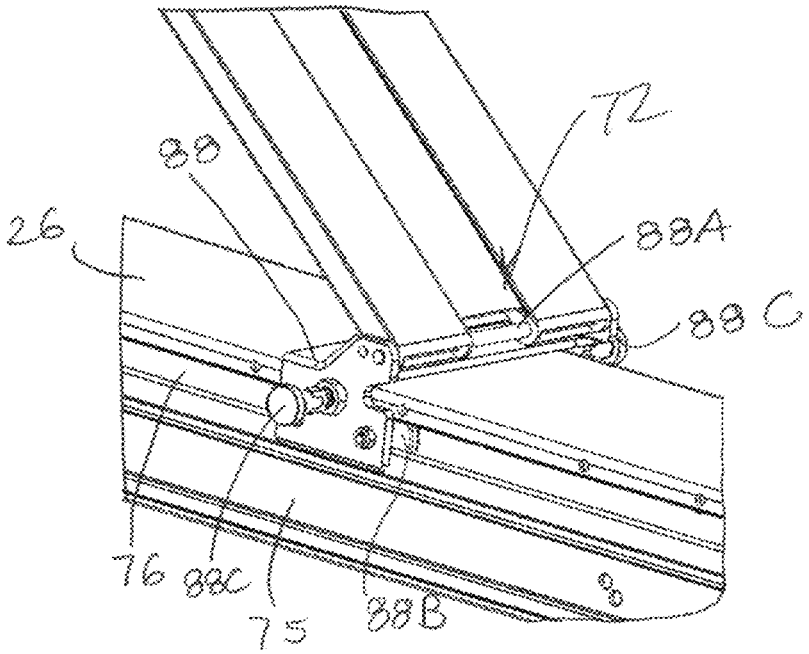
FIG. 22 is an enlarge partial view of a rear lower slide joint the seatback in an inclined position as taken from the side rear.
Figure 23:
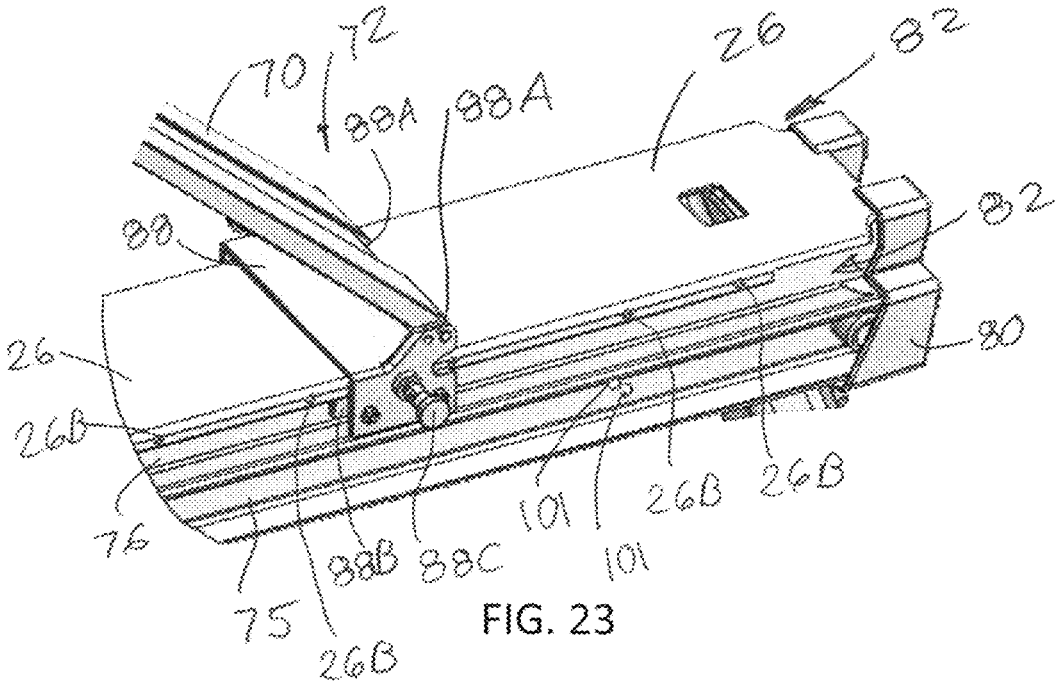
FIG. 23 is an enlarge partial view of the lower slide joint the seatback in an inclined position as taken from the side front.

The lower pivot joint 72 at the lower end of the frame rail 70 also is pivotally and slidably connected to the upper slide track 76 as seen in FIGS. 20, 22 and 23, but the lower pivot joint 72 is also lockable in position to fix the incline of the seatback 15. The lower pivot joint 72 has a lower bracket 88 that is pivotally connected to frame rail 70 by pin 88A, and is slidably connected to the upper slide track 76 by slides 88B. The lower bracket 88 also has lock members 88C that can releasably engage with corresponding bores in the main beam 26 to lock the lower end of the frame rail 70 in position, which thereby holds the incline of the seatback 15. When the lock members 88C are released or unlocked, the entire seatback 15 is slidable along the upper slide track 76 and here again, may be removed from the main beam 26 by sliding the slides 88B along the upper slide track 76 and out of the track openings 82.

Figure 24:
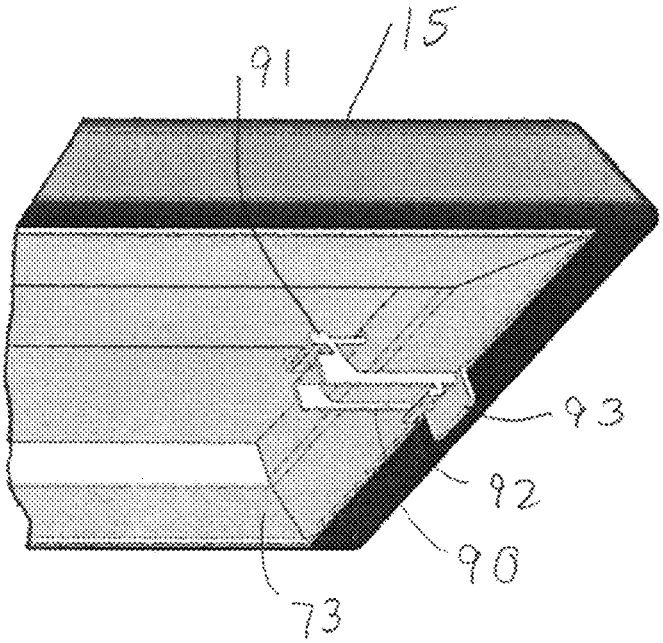
FIG. 24 is a bottom perspective view of a back end of the seatback.
Figure 25:
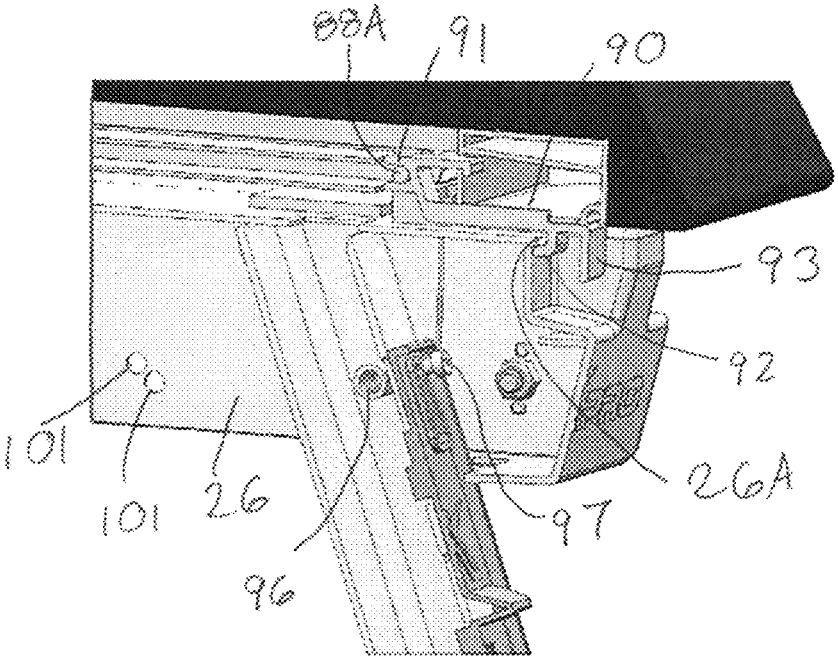
FIG. 25 is a side cross sectional view of the back end of the seatback and a latch assembly thereof in a latched position.
Figure 26:
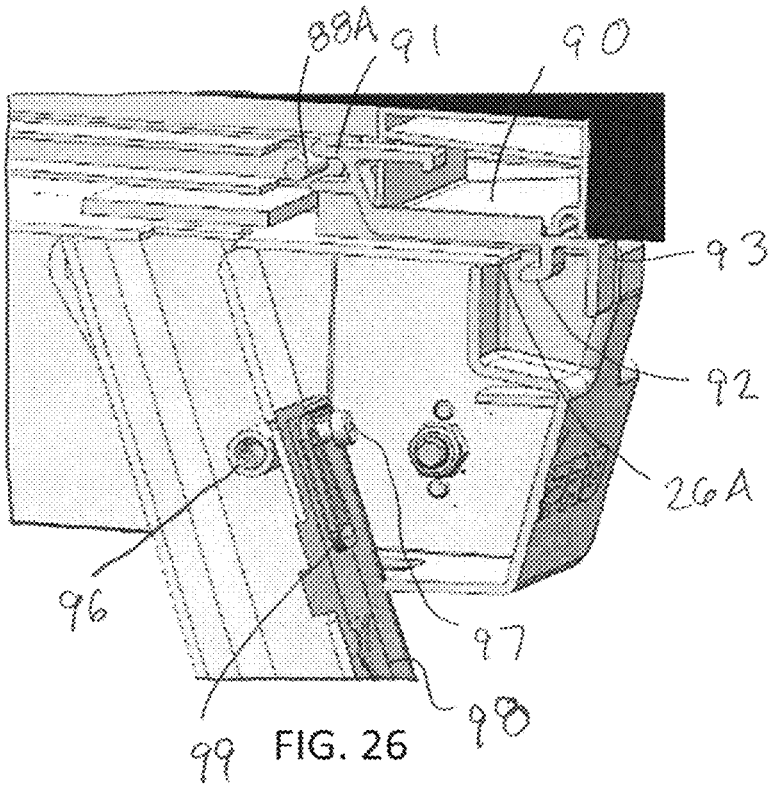
FIG. 26 is a side cross sectional view of the back end of the seatback and a latch assembly thereof in an unlatched position.

While the seatback 15 is formed as an assembly wherein the frame rail 70 is loosely pivoted to the interior seatback frame 73, the seatback 15 also includes a latch 90 that is shiftable between the engaged position of FIG. 25 and the disengaged position of FIG. 26. As seen in FIG. 24, the latch 90 is slidably supported on the seatback frame 73 and comprises a first catch 91, a second catch 92 and a manual actuator 93. The first catch 91 is configured to engage an edge portion of the frame rail 70, which may be defined by the lock member 88C. The second catch is configured to engage an edge portion 26A of the main beam 26 as seen in FIG. 25. In this condition, the latch 90 engages the main beam 26 and the frame rail 70 to thereby prevent the seatback 15 from being raised.

When the latch 90 is actuated to the disengaged position of FIG. 26, the seatback frame 73 and frame rail 70 can pivot upwardly to adjust the incline of the seatback 15. As seen in FIG. 23, the main beam 26 also includes pairs of locking bores 26B so that the lock members 88C on the lower pivot joint 72 can engage the locking bores 26B and hold the seatback 15 at a desired incline. Multiple locking bores 26B are spaced along the length of the main beam 26, wherein each locking bore 26B defines a different angle of incline for the seatback 15. When unlocked, the seatback 15 can be lowered, and the latch 90 can be reengaged to hold the frame rail 70 latched to the seatback frame 73.

Notably, the seatback 15 can be removed from the main beam 26 by releasing any lock members 85C or 88C, which allows the seatback 15 to be slid out of the upper slide track 76 through the open ends 82 thereof. However, the latch 90 remains engaged with the frame rail 70 during this horizontal sliding movement since the second latch 92 can slide away from the beam edge 26A. When removed, the seatback 15 and its frame rail 70 are held compactly together and the frame rail 70 is unable to pivot away from the interior frame 73 due to the latch 90.

Figure 27:
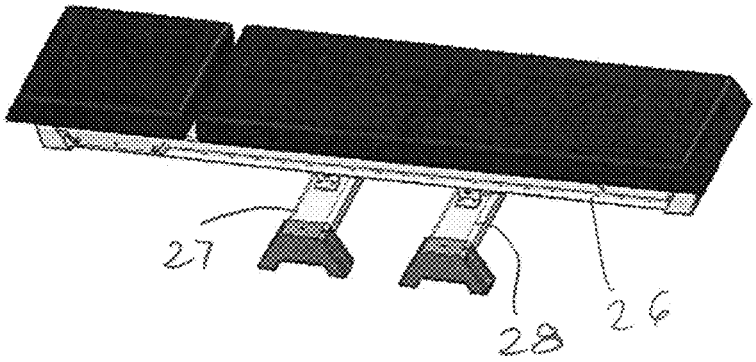
FIG. 27 illustrates the bench unit with the front and back legs thereof folded.
Figure 28:
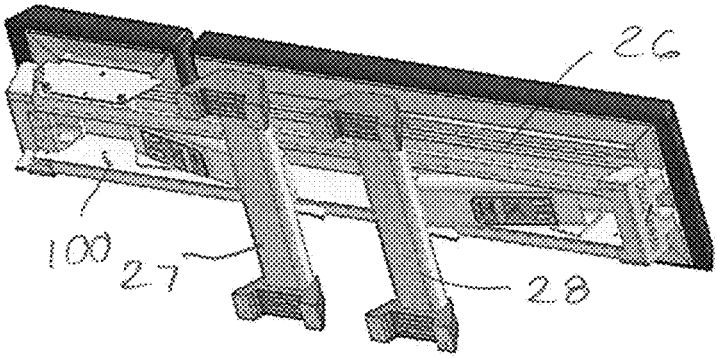
FIG. 28 is a bottom perspective view of the bench unit of FIG. 28.
Figure 29:
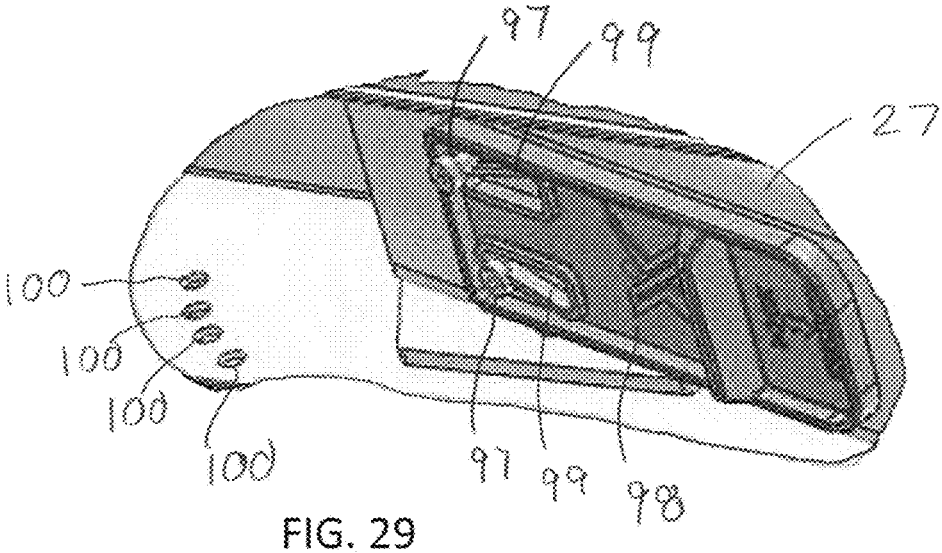
FIG. 29 is an enlarged view of a leg lock assembly.

Next, the bench unit 12 is foldable to the folded condition of FIGS. 27 and 28, which allows for compact storage. Each leg 27 and 28 is pivotally connected to the main beam 26 by pivot pin 95 (see FIGS. 18 and 19). Each leg 27 and 28 also includes a locking unit to lock the leg 27 and 28 into the unfolded position (FIG. 1), the folded position (FIG. 28) or a number intermediate, angled positions as described hereafter. The locking unit preferably comprises one or more lateral lock pins 96 on each leg 27 or 28 that reciprocates sidewardly to engage the side walls of the main beam 26. The lock pins 96 each connect to a connecting control pin 97 that can be moved sidewardly to effect reciprocating movement of the associated lock pin 96. To control this sideward pin movement, each pair of control pins 97 in a respective leg 27 or 28 engages with a cam plate 98 formed with two tapered slots 99 as seen in FIG. 29. The cam plate 98 can be slid along the face of the respective leg 27 or 28 so that the tapered slots 99 either move the control pins 97 inwardly to unlock the respective leg 27 or 28 or outwardly to lock the respective leg 27 or 28.

Each leg 27 or 28 is also disposed adjacent to a respective array of locking bores such as the bores 100 shown in FIG. 29. For the front leg 27, four bores 100 are provided which allows the leg 27 to be fixed in any of four angular positions to thereby vary the height at the front end of the bench unit 12. Similarly, FIG. 25 shows two locking bores 101 for the back leg 28 that permit adjustment of the angular position of the back leg and thereby vary the height at the back end of the bench unit 12. Because the leg positions can be adjusted, the cross bars 27B and 28B are also pivotal relative to the leg posts 27A and 27B to ensure that the foot blocks 48 remain in flat contact with the floor.

Figure 30:
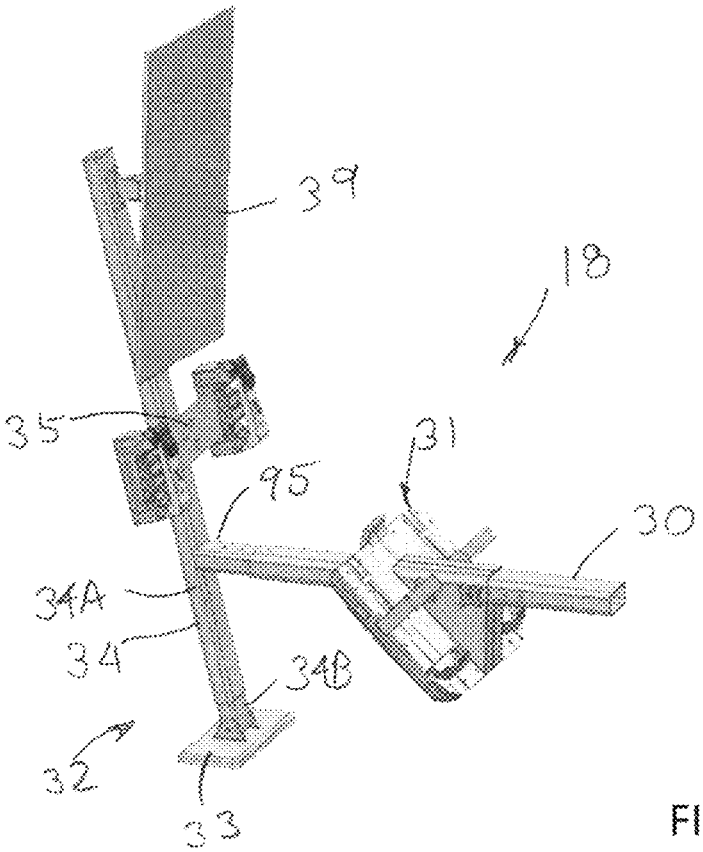
FIG. 30 is a perspective view of the extension unit.
Figure 31:
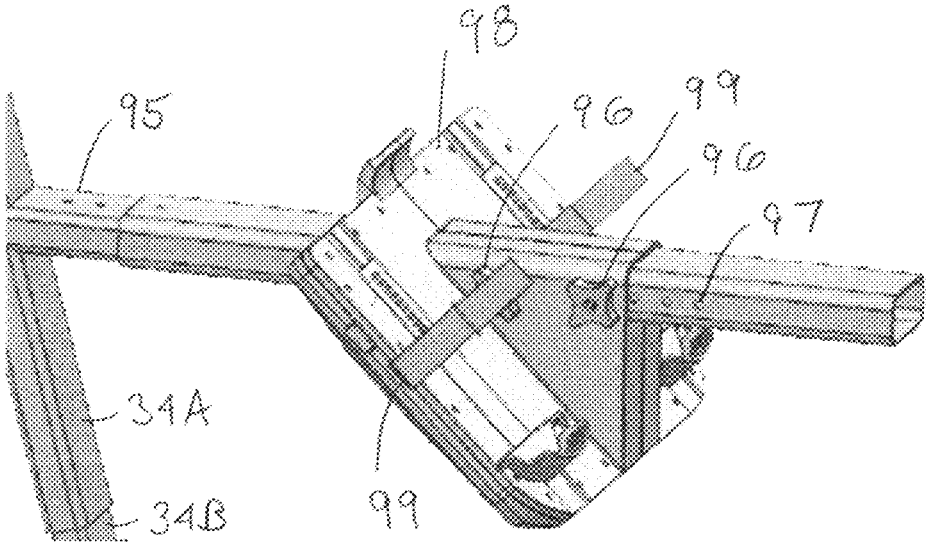
FIG. 31 is an enlarged partial view of a foot stretcher on the extension unit.
Figure 32:
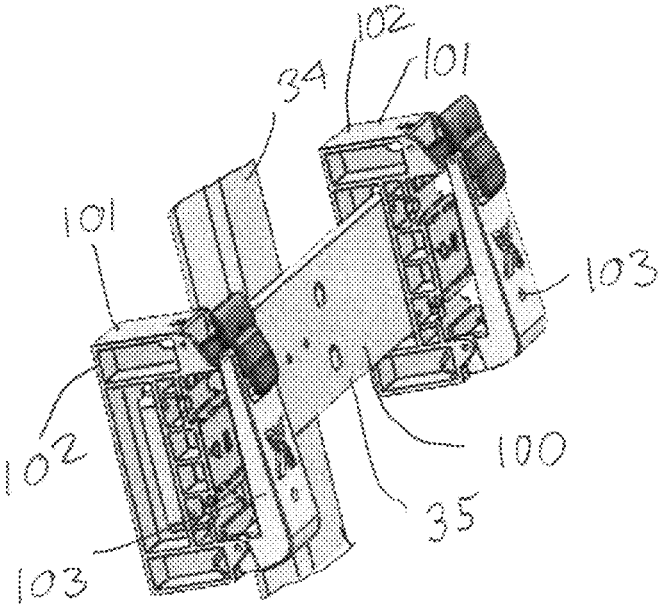
FIG. 32 is an enlarged partial view showing a mount for securing the resistance unit to the front extension unit.

Next as to FIGS. 30-31, the extension unit 18 is formed as a removable substructure that is removably mountable to the bench unit 12. The support rail 30 has a back end section that can be removably inserted into the rail socket 43 at the front end of the bench unit 12, and can be locked in a selected position by the lock unit 81 (FIGS. 18 and 19). The support rail 30 extends forwardly and has a rail extension 95 that telescopes out of the support rail 30 and allows the distance of the upright 34 relative to the bench unit 12 to be adjusted and then locked through suitable locking bores and a pin.

The foot support or foot stretcher 31 is mounted on the support rail 30 so as to be slidable therealong to permit adjustment of the distance between the foot stretcher 31 and the front end of the bench unit 12. The foot stretcher 31 can include lock knobs 96 that engage with locking bores 97 to fix the position of the foot stretcher 31. The foot support or foot stretcher 31 includes a support panel 98 with foot straps 99 to anchor the feet of the user when sitting on the bench unit 12. As noted, the user can position their feet in the foot stretcher 31 and optionally, the seat 14 can be fixed in position when performing resistance exercises such as seated rows, or the seat 14 may be slidable when performing the user operates the exercise device 10 as a rowing machine or as a form of a squat machine for working the legs.

As noted, the front end of the support rail 30 connects to the front support frame 32, which includes the foot pad 33 and the upright 34. Since the bench legs 27 and 28 can be adjusted to vary the horizontal angle of the bench surface 16, the foot pads 33 also can pivot or swivel relative to the upright 34 to maintain flat contact with the floor. Further, the upright comprises a fixed post 34A that is fixed to the rail extension 95, and comprises an adjustable post 34B that projects downwardly to the foot pad 33 and is slidable vertically relative to the fixed post 34A to vary the vertical length of the upright 34 and maintain the foot pad 33 in contact with the floor 11 as the bench surface angle is adjusted. For example, FIG. 3 shows the bench surface 16 defined by the seat 14 and the main beam 26 positioned at a small incline relative to the floor 11 with all of the foot pad 33 and foot blocks 48 disposed in contact therewith. In another example, if the angle of the front leg 27 is changed so that the front of the bench unit 12 is raised, the fixed post 34A also rises, but the adjustable post 34B is lowered or extended to maintain the foot pad 33 in contact with the floor 11. As these angles change, the foot pad 33 and foot blocks 48 also can pivot so that their respective bottom surfaces can lie flat on the floor 11.

Figure 33:
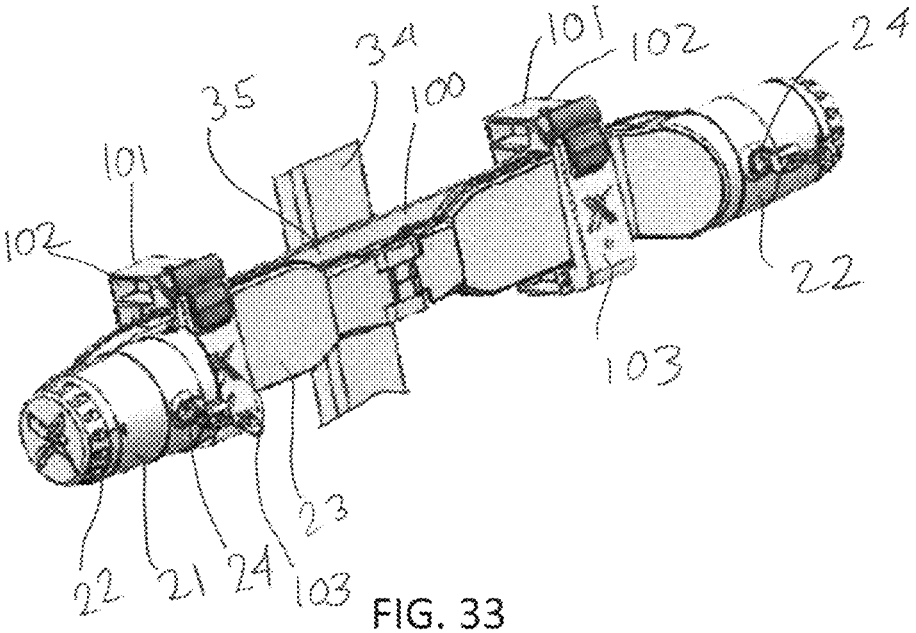
FIG. 33 illustrates the resistance unit mounted to the mount therefor.

As noted above, the upright 34 is configured to support the resistance unit 21 thereon (FIGS. 322 and 33) by the mount 35. The mount 35 is configured to removably secure the resistance unit 21 in an intermediate position at an elevation just above the foot stretcher 31, wherein the pull cord 24 may extend horizontally toward the bench unit 12. The mount 35 comprises a cross rail 100 fixed to the upright 34, which includes mounting latches 101 on the opposite ends thereof. The mounting latches 101 comprise fixed brackets 102 in which the platform 23 of the resistance unit 21 is received. The mounting latches 101 further include locking arms 103 that pivotally connect to the fixed brackets so that the locking arms 103 can swing open for insertion of the platform 23 into the fixed brackets 102 and can swing closed and be latched in position as seen in FIG. 33 to secure the resistance unit 21 to the mount 35. The resistance unit 21 then can be used as described herein, but also is removable for use separate from the exercise device 10 or for relocation to one of the hi, lo or intermediate positions disclosed herein.

Further, the resistance unit 21 can be mounted as shown with the pull cords 24 exiting the resistance modules 22 in the direction 37 (FIG. 3) of the bench unit 12. However, the resistance unit 21 may be rotated 180 degrees so that the pull cords 24 would extend away from the bench unit 12, such as when exercises are performed on the front side of the extension unit 18.

In use, only one resistance unit 21 need only be provided since it is readily positionable at any of the hi, lo or intermediate positions described above. However, two or more resistance units 21 may be provided simultaneously on the exercise device 10.

As such, the resistance unit 21 is mountable to the bench unit 12 or the extension unit 18 in a plurality of mounting positions that align with the various bench configurations to permit the performance of a wide variety of resistance exercises while varying the angle of resistance generated by each pull cord 24 on the body party being exercised. The mounting positions optimize the location of the resistance unit 21 and the pull cords 24 depending upon the bench configuration to vary and optimize the angle of resistance applied to the user's muscles and body parts during exercises. The inventive exercise system 10 is usable by athletes of all experience levels and is particularly suitable for advanced athletes who might perform variations of a particular exercise to hit different muscles in an area of the body.

In more detail, the mounting positions allow for the pull cords 24 to be extended in multiple vertically and horizontally extending orientations, so that exercises performed on the exercise system 10 mimic common exercises, such as various presses, flies, rows, curls, squats, lifts, and the like. While the pull cord 24 may be pulled upwardly for certain exercises when the resistance unit 21 is mounted on the bottom of the bench unit 12, the resistance unit 21 may also be mounted to permit downward pulling of the pull cord such as in the hi position 42 (FIG. 3) for other exercises such as pulldowns, curls and the like. The resistance unit 21 is also mountable in the intermediate position on the extension unit 18 to perform other exercises on the bench unit 12 or in front of the extension unit 18. Exercises may be done fast or slow. In these configurations, the resistance module 21 may be positioned in the lo, hi or intermediate positions either by locating the resistance unit 21 directly in one of these positions, or virtually, through the use of pulleys and/or accessory cables, which here again, permits the performance of a wide variety of exercises using one or only a few resistance modules.

Although particular preferred embodiments of the invention have been disclosed in detail for illustrative purposes, it will be recognized that variations or modifications of the disclosed apparatus, including the rearrangement of parts, lie within the scope of the present invention.

We claim:

1. A bench system comprising:

a configurable bench unit, said bench unit defining an upward facing body support surface supported on a base, wherein said base comprises bench legs extending downwardly below said body support surface for support on a floor surface, at least one said bench leg defining a respective downward opening channel, which opens downwardly toward said floor surface;

a resistance unit comprising at least one resistance module including a coil storage spool configured to wrap and unwrap a pull cord about a sideward module axis with said pull cord emanating from said resistance module in a pulling direction away from said module axis and said resistance unit further including an elongated base plate extending from said resistance module in a plate direction extending sidewardly along said module axis, said pull cord terminating at an outer end with a connector connectable to one of a handle or other exercise implements, wherein said pull cord has a length sufficient to allow pull strokes with a length suitable for performing multiple exercises by a user, said resistance module at least generating resistance to extension of said pull cord;

said resistance unit being removably fixable to said bench unit in a vertically-confined position allowing said pull cord to be extended and retracted by a user and being separable from said bench unit for the performance of exercises separate from said bench unit, wherein said channel fits on top of said base plate from above with said channel confining said base plate vertically from above to prevent upward movement of said base plate relative to said bench unit while said base plate is confined vertically from below by said floor surface when said bench unit is positioned on said floor surface; and said bench unit being configurable in at least one bench configuration comprising one of a flat configuration for supporting said user flat on their back on said body support surface, a seated configuration for supporting said user in a seated position on said body support surface, an incline configuration wherein said user's upper body is oriented in an incline with their head above their hips on said body support surface, a decline configuration wherein said user's upper body is oriented with their hips above their head on said body support surface, and a sliding seat configuration wherein said body support surface of said bench unit comprises a back section and a seat section which is slidable horizontally toward and away from said back section, wherein said base plate of said resistance unit fits removably into said channel from below so as to be vertically confined such that an upward lifting force is generated by said user pulling said pull cord and a counterforce acting against said lifting force is generated by the user's body acting on top of said body support surface so that said resistance unit is restrained upwardly by said channel engaged therewith and downwardly solely by said floor surface on which said bench unit is positioned.

2. The bench system according to claim 1 wherein said resistance module comprises sensors for collecting data relating to user performance characteristics and relaying said data to a computing device for display and processing.

3. The bench system according to claim 1, wherein said resistance unit comprises said elongated base plate having a pair of said resistance modules at opposite ends of said base plate, which act concentrically and independent of each other, said base plate extending through said channel in contact with said floor surface with said resistance modules being disposed outwardly of each said channel engaged with said resistance unit, so that sideward movement of said resistance unit relative to said bench unit is prevented by said resistance modules.

4. The bench system according to claim 3, wherein each said resistance module generates variable resistance that can reproduce resistance that spans a range of weights.

5. The bench system according to claim 3, wherein said pull cord of each of said resistance modules may be extended and retracted by a respective body part of said user, wherein said body part comprises one of the left and right arms and legs of said user.

6. The bench system according to claim 3, wherein said resistance modules are actuated independently and separately, and said pull cords are interconnected so as to be moved by a single body part of said user driving both pull cords simultaneously.

7. The bench system according to claim 1, which further includes an upright is disposed forwardly of a front section of said bench unit wherein a respective said resistance unit is mountable to said upright so that additional exercises may be performed on said bench unit or separate from said bench unit using said resistance unit on said upright.

8. The bench system according to claim 7, wherein said resistance unit is mountable to said mast at an intermediate position in front of said bench unit and is mountable in a high position located in front of and higher than said bench unit and said intermediate position.

9. The bench system according to claim 8, wherein said resistance unit is confined vertically below said base of said bench unit proximate said floor surface so as to be located in a low position below a height of said body support surface defined on said bench unit, said resistance unit being selectively mountable in any one of said low, intermediate and high positions to vary an angle of said pull cord relative to said user during exercises.

10. The bench system according to claim 1, wherein each said channel projects downwardly over opposite edges of said base plate to confine said resistance unit to prevent movement forwardly and rearwardly relative to opposite front and back ends of said bench unit wherein said resistance unit is movable along said floor surface in combination with said bench unit.

11. The bench system according to claim 1, wherein said base of said bench unit comprises a plurality of bench legs, which each define a plurality of foot blocks positioned for support on said floor surface, each of said first and second bench legs defining a mounting position for said resistance unit wherein each said foot block defines a respective said channel therein such that each said mounting position supports said resistance unit by a plurality of said channels into which said resistance unit is fit.

12. A bench system comprising:

a configurable bench unit, said bench unit defining an upward facing bench surface supported on a base, wherein said base comprises bench legs extending downwardly below said bench surface for support on a floor surface, each said bench leg defining a respective downward opening channel, which opens downwardly toward said floor surface;

a resistance unit comprising at least one resistance module including a coil storage spool configured to wrap and unwrap a pull cord about a sideward module axis with said pull cord emanating from said resistance module in an extension direction extending away from said module axis and said resistance unit further including an elongated base plate extending from a bottom of said resistance module in a plate direction extending sidewardly along said module axis for support on said floor surface, said pull cord terminating at an outer end with a connector connectable to one of a handle or other exercise implements, wherein said pull cord has a length sufficient to allow pull strokes with a length suitable for performing multiple exercises by a user, said resistance module generating resistance to extension of said pull cord;

said resistance unit being fixable to said bench unit in a vertically-confined position allowing said pull cord to be extended and retracted by a user and being separable from said bench unit for the performance of exercises separate from said bench unit, wherein each said channel fits over said base plate of said resistance module to confine said base plate vertically from above to prevent upward movement of said base plate while said base plate is confined vertically from below by said floor surface; and said resistance unit being mountable to said bench unit in a plurality of mounting positions defined by said channels of said bench legs to permit the performance of a variety of resistance exercises while varying the angle of resistance generated by said pull cord on the body part being exercised, wherein said base plate of said resistance unit fits removably into each said channel from below such that an upward lifting force is generated by a user pulling said pull cord and a counterforce opposite said lifting force is generated by the user's body acting on top of said bench surface so that said resistance unit is restrained upwardly by said channel engaged therewith and downwardly by said floor surface.

13. The bench system according to claim 12, wherein said bench unit is configurable in various bench configurations including at least two of a flat configuration for supporting a user flat on their back, a seated configuration for supporting a user in a seated position, an incline configuration wherein said user's upper body is oriented in an incline with their head above their hips, a decline configuration wherein said user's upper body is oriented with their hips above their head, and a sliding seat configuration wherein said bench unit defines a seat section which is slidable horizontally toward and away from a back section.

14. The bench system according to claim 12, wherein said mounting positions allow for said pull cord to be extended in multiple vertically and horizontally extending orientations, so that exercises on said bench system mimic different exercises, comprising presses, flies, rows, curls, squats, and lifts.

15. The bench system according to claim 12, wherein each said channel projects downwardly over opposite edges of said base plate to confine said resistance unit to prevent movement forwardly and rearwardly relative to opposite front and back ends of said bench unit wherein said resistance unit is movable along said floor surface in combination with said bench unit.

16. The bench system according to claim 12, wherein each of said bench legs define a plurality of foot blocks positioned for support on said floor surface, each of said bench legs defining one of said plurality of mounting positions for said resistance unit wherein each said foot block defines a respective said channel therein such that each said mounting position supports said resistance unit by a plurality of said channels into which said resistance unit is fit.

17. A bench system comprising:

a configurable bench unit configured to support a resistance unit comprising at least one resistance module including a coil storage spool configured to wrap and unwrap a pull cord about a sideward module axis with said pull cord emanating from said resistance module in an extension direction extending away from said module axis and said resistance unit further including an elongated base plate extending sidewardly along said module axis from a bottom of said resistance module for support on a floor surface, said pull cord terminating at an outer end with a connector connectable to one of a handle or other exercise implements, wherein said pull cord has a length sufficient to allow pull strokes with a length suitable for performing multiple exercises by a user, said resistance module generating resistance to extension of said pull cord;

said bench unit comprising a base and an upward facing bench surface supported above said floor surface by said base, said base comprising a downward opening channel, which opens downwardly toward said floor surface, said channel being configured to support said resistance module in a non-movable position allowing said pull cord to be extended and retracted by a user and being separable from said bench unit for the performance of exercises separate from said bench unit, wherein said channel fits removably over said base plate of said resistance module to confine said base plate vertically from above to prevent upward movement of said base plate while said base plate is confined vertically from below by said floor surface such that an upward lifting force is generated by said user pulling said pull cord and a counterforce opposite said lifting force is generated by the user's body acting on top of said bench surface so that said resistance unit is restrained upwardly by said channel engaged therewith and downwardly by said floor surface; and said bench unit being configured in at least one bench configuration comprising one of a flat configuration for supporting the user flat on their back, a seated configuration for supporting the user in a seated position, an incline configuration wherein said user's upper body is oriented in an incline with their head above their hips, a decline configuration wherein said user's upper body is oriented with their hips above their head, and a sliding seat configuration wherein said bench unit defines a seat section which is slidable horizontally toward and away from a back section.

18. The bench system according to claim 17, which further includes an upright positioned in front of a front section of said bench unit and comprising a mount to which a said resistance unit is mountable so that additional exercises may be performed on or separate from the bench unit using said resistance unit on said upright.

19. The bench system according to claim 18, wherein said upright is provided with an extension unit that includes a foot support that anchors the feet of the user when sitting on the bench unit and includes a support frame configured to support a said resistance module on said extension unit separate from said mount.

20. The bench system according to claim 19, wherein said bench unit is configured with a seat section and back section that define said bench surface so that a said pull cord may extend horizontally toward said seat section of said bench unit, said seat section being fixable in a fixed position relative to said back section and releasable to permit sliding therein, wherein when said seat section is fixed and the user faces the bench unit, the user may perform seated exercises, and said user may also reverse their position and press the pull cord, and wherein when said seat is released to define a sliding seat configuration, said bench system can operate as a rowing machine.

21. The bench system according to claim 17, which further includes an extension unit disposed forwardly of said bench unit that comprises a mast that extends upwardly and allows a said resistance unit to operate in a hi configuration, either by directly positioning said resistance unit hi on an upper section of said mast or virtually by providing a hi-mount cable connected by a pulley and cable assembly on said mast which connects to a said resistance module that is located in an intermediate or lo position on said extension unit or on said base of said bench unit.

22. The bench system according to claim 17, wherein said base of said bench unit comprises bench legs, which each define a respective said channel wherein said bench legs are adjustable for at least one of folding of said bench legs for storage, and adjusting a horizontal angle of said bench surface.

23. A bench system comprising:

a configurable bench unit configured to support a resistance unit comprising at least one resistance module including a coil storage spool configured to wrap and unwrap a pull cord about a sideward module axis with said pull cord emanating from said resistance module in an extension direction extending away from said module axis and said resistance unit further including an elongated base plate extending sidewardly along said module axis from a bottom of said resistance module for support on a floor surface, said pull cord terminating at an outer end with a connector connectable to one of a handle or other exercise implements, wherein said pull cord has a length sufficient to allow pull strokes with a length suitable for performing multiple exercises by a user, said resistance module generating resistance to extension of said pull cord;

said bench unit comprising a base and an upward facing bench surface supported above said floor surface by said base, said base defining a plurality of mounting locations for said resistance unit defined by a plurality of downward opening channels, which each open downwardly toward said floor surface, each said channel being configured to support said resistance module in a non-movable position allowing said pull cord to be extended and retracted by a user and being separable from said bench unit for the performance of exercises separate from said bench unit, wherein each said channel fits over and projects downwardly over opposite edges of said base plate to confine said resistance unit to prevent movement forwardly and rearwardly relative to opposite front and back ends of said bench unit wherein said resistance unit is movable along said floor surface in combination with said bench unit, and further wherein each said channel fits removably over said base plate of said resistance module to confine said base plate vertically from above to prevent upward movement of said base plate while said base plate is confined vertically from below by said floor surface such that an upward lifting force is generated by said user pulling said pull cord and a counterforce opposite said lifting force is generated by the user's body acting on top of said bench surface so that said resistance unit is restrained upwardly by said channel engaged therewith and downwardly by said floor surface.

* * * * *